US005083119A

United States Patent [19]

Trevett et al.

[11] Patent Number: 5,083,119

[45] Date of Patent: Jan. 21, 1992

[54] STATE MACHINE CONTROLLED VIDEO PROCESSOR

[75] Inventors: Neil F. Trevett, Kingston-upon-Thames; Malcolm E. Wilson, Bridport, both of England

[73] Assignee: Du Pont Pixel Systems Limited, United Kingdom

[21] Appl. No.: 286,080

[22] Filed: Dec. 19, 1988

[30] Foreign Application Priority Data

Feb. 11, 1988 [GB] United Kingdom ..... 8893102

[51] Int. Cl.[5] ..... G09G 5/40

[52] U.S. Cl. ..... 340/723; 340/721; 340/724; 340/734

[58] Field of Search ..... 340/721, 724, 726, 731, 340/798, 799, 723, 734

[56] References Cited

U.S. PATENT DOCUMENTS

| | | | |
|---|---|---|---|
| 4,129,860 | 12/1978 | Yonezawa et al. | 340/731 |
| 4,317,114 | 2/1982 | Walker | 340/734 |
| 4,562,435 | 12/1985 | McDonough et al. | 340/799 |
| 4,663,617 | 5/1987 | Stockwell | 340/726 |
| 4,688,032 | 8/1987 | Saito et al. | 340/724 |
| 4,766,431 | 8/1988 | Kobayashi et al. | 340/799 |
| 4,799,173 | 1/1989 | Rose et al. | 340/727 |
| 4,816,817 | 3/1989 | Herrington | 340/724 |
| 4,818,979 | 4/1989 | Manson | 340/721 |
| 4,868,552 | 9/1989 | Chang | 340/734 |

OTHER PUBLICATIONS

"Hardware Control of Display Screen Windows", IBM Technical Disclosure Bulletin, vol. 28, No. 9, Feb. 1986.

*Primary Examiner*—Jeffery A. Brier

*Attorney, Agent, or Firm*—Sterne, Kessler, Goldstein & Fox

[57] ABSTRACT

A system and method of merging and manipulating pixel information for display on a raster scan monitor is disclosed. The invention operates at speeds imperceptible to the viewer by collecting, in each memory access cycle, the data representing multiple pixels and by performing merge and manipulation functions on pixel groups at video rate under control of control data from a state machine. The state machine allows for unique processing decisions to be made for every pixel group displayed on the monitor.

36 Claims, 13 Drawing Sheets 200
202
204
206
208
210
212
214
216
218
220
222
224
226
228
230
232
234
236
238
240
242
244
246
248
250
252
254
256
258
260
262
264
266
268
270
272
274
276
278
280
282
284
5 BIT REG.
21:1 MUX
5 WAY 2:1 MUX
A
B
SEL
LOGICAL Ø
PIXEL GROUP DATA Ø
INPUT CLOCK Ø
PIXEL GROUP DATA 1
INPUT CLOCK 1
SECONDARY CLOCK
CONTROL DATA (21-25)
CONTROL DATA (16-20)
CONTROL DATA (11-15)
CONTROL DATA (6-10)
CONTROL DATA (1-5)
PRIMARY CLOCK
CONTROL SELECT

STATE MACHINE CONTROLLED VIDEO PROCESSOR

I. BACKGROUND OF THE INVENTION

1. Field of the Invention

This invention relates to graphics and imaging on digital computer systems.

2. Related Art

The invention of high speed/high resolution bit mapped display monitors has made possible many advances in the fields of imaging and graphics. In addition, the invention of video RAM (Random Access Memory) has simplified the storage and display of imaging and graphics data. For example, modern image/frame memories, (i.e. the memory used to refresh the image on the display monitor), are often designed so as to utilize the video RAM's serial output registers. For the purposes of this specification these image/frame memories may alternately be referred to as "frame memories" or "framestores".

Despite the advances which both of these inventions have spawned there are still many areas in the imaging and graphics field which are in need of improvement. One of these areas is the interface between data coming out of the video RAMs serial output and the high speed/high resolution bit mapped display monitor. The general problem in this area relates to speed. While modern day high resolution bit mapped devices can often accept and display data at clock rates of 125 MHZ and higher, modern video RAMs can only provide data at a clock rate of about 25 MHZ.

In order to deal with this disparity in clock rates, many imaging and graphics computer systems access, (from frame memory), image data representing more than one pixel at a time in order to refresh the display monitor. This package of accessed data will be referred to as a "pixel group" for purposes of this specification. Systems which utilize "pixel group" accessed data to refresh the display monitor will be referred to as "pixel group access systems". For example, if eight bits of data are used to represent every pixel, and the complete data representing each pixel can be clocked out of memory at 25 MHZ, then 5 pixels worth of information (40 bits) will have to be clocked out of memory in each access cycle in order to keep up with the display monitor. For a second example, if each pixel is only defined by one bit of information, (e.g. in a monochrome display), then pixel data need only be clocked out of memory 5 bits at a time in order to keep of with the display monitor.

From the foregoing examples it may be understood that as the number of bits used to define each pixel increases, (for example, 4 bits per pixel will allow 16 colors to be defined), the number of bits which must be clocked out of RAM in each access cycle increases proportionally. Given that the video RAMS must supply data to the display monitor at the monitors clock rate (i.e. video rate), the computer designer is then faced with the problem of processing the data to be displayed at a rate which will not be perceptible to a person viewing the display screen.

For example, assume that an image is to magnified, (i.e. zoomed), at a 2 to 1 ratio. Each pixel used to make up the original image must be duplicated in both the horizontal and vertical directions, and unwanted data must somehow be "pushed" out of the displayed picture.

A common way of accomplishing this is through the use of software. A program may simply read the stored image and duplicate each piece of image data, as required, in the framestore. In the meantime, data must still be supplied to the display device. The result of the operation is that the viewer will perceive some "zoomed" image portions on the monitor concurrently with "not yet zoomed" portions of the image. Eventually the entire image will appear magnified, (zoomed), but in the interim, an unfinished, intermediate image will be perceived.

In low resolution devices, where video pixel data may be accessed one piece at a time, this problem may be solved by merely holding the same pixel data at the display monitors digital to analog converter (DAC) for two clock cycles and repeating the complete data for two successive line scans on the display monitor. This technique is only possible, however, because in older, low resolution systems, data representing only one pixel need be accessed at a time due to the slow speed of the display monitor.

From the foregoing discussion, it may be seen that the low resolution solution to the magnification problem will not successfully create a zoomed image in pixel group access systems. In systems which access pixels in groups to refresh the display monitor, holding the same pixel data at the input DAC of the display monitor would merely produce a repetitive pattern of pixel groups which are not representative of the image. By way of illustration, assume an image is made up of 10 pixels—A,B,C,D,E,F,G,H,I, and J. The first line of a 2:1 magnified image should appear as A,A,B,B,C,C,D,-D,E,E,F,F,G,G,H,H,I,I,J,J. In a modern system, (which in this example accesses data representing five pixels at a time), the first pixel group accessed from memory will contain the information for pixels A,B,C,D and E. If the accessed data is held at the input of the display monitors DAC for two clock cycles the image on the monitor will appear as—A,B,C,-D,E,A,B,C,D,E. Similarly, data acquired on the second pixel group access would appear as F,G,H,I,J,F,G,-H,I,J. It should be easily observed that this is not the desired result.

Performing the magnification or zoom, function at a speed which makes the processing imperceptible to a viewer is not the only problem encountered in modern imaging and graphics systems. Window manipulation, at imperceptible speeds, and within pixel group boundaries can also be a formidable task.

One way of opening a window on a display monitor is through software manipulation of the frame data. The formation and/or manipulation of the window may be accomplished by first storing the windowed image data in a second memory (which is relatively slow) and then transferring the new, processed image to the frame memory. Software window manipulation may also be accomplished by dynamically altering the contents of the frame memory (which will often create viewer perceptible artifacts on the display monitor).

One problem with some software solutions is that the processing operation often destroys the originally stored image data. Further, pixel group accessing of data makes it impracticable for many imaging and graphics systems to open a window that starts and/or ends within the boundaries of an individual pixel group (i.e. part of the pixel group contains window data and part does not).

The use of video RAMs makes even hardware solutions to windowing problems difficult to achieve. The serial shift register inside the video RAM holds data for one line of the display monitor. This data is held serially and is perpetually being clocked out as the monitor is refreshed. In order to create a window, many systems need to dynamically readdress the video RAM and cause new data to be transferred into the serial shift register. The fact that data is perpetually being transferred from the video RAMs to the monitor's video DAC makes it difficult or impossible to perform this transfer without creating artifacts, (noise), on the display monitor. An example of a hardware window apparatus that is suited to systems which do not use video RAMs or pixel group accesses may be seen in U.S. Pat. No. 4,642,621 to Nemoto et al. which, in its entirety, is incorporated by reference herein as if printed in full below.

Operations such as panning also require processing time which may often be viewer perceptible. Further, the mere fact that pixel data has been accessed as a pixel group, from a video RAM, makes the panning processing a more complicated matter than it would otherwise be. Pixel group accessing may also make any manipulation of individual pixel data difficult. For example, moving an image within pixel group boundaries may pose a complex problem for pixel group access systems.

It would be desirable to be able to process pixel group accessed data so as to perform functions such as pan, zoom and window manipulation at a high enough rate so that such processing is imperceptible to a viewer. It would also be desirable to be able to perform these functions without destroying the integrity of the image data held in the framestores. It would be desirable to be able to perform merge and manipulate operations on pixel group accessed data at viewer-imperceptible speeds. It would also be desirable to perform such functions on pixel group accessed data at the granularity of a single pixel. Further, it would be desirable to be able to perform such functions, at video rate, on the data from more than one framestore.

II. SUMMARY OF THE INVENTION

The present invention provides a system and method of merging and manipulating pixel information for display on, for example, a raster scanned monitor. The system may be operated at speeds imperceptible to the viewer by collecting, in each pixel input clock cycle, the data representing groups of pixels and by performing merge and manipulation functions on pixel groups at video rate. For the purposes of this specification, the word "manipulate" refers to the processing of groups of pixel data, representing any number of pixels, so as to form a one or more output pixel groups. The word "merge" refers to a particular type of manipulation whereby the data from more than one pixel group is combined so as to form a single output pixel group.

In a preferred embodiment, the invention makes use of registers and multiplexer circuits. The input registers collect data from frame storage. The multiplexer circuits, under control of a state machine, allow such functions such as merge, pan, zoom, and window manipulation to be performed at video rate, at the granularity of an individual pixel even when video RAMs are used to access and display the pixel data as groups of pixels.

In the above embodiment, a pair of input registers are used as pipelines for the input from each of a pair of framestores. Advantageously, the use of pairs of registers allows the data to be derived from either "current" or "previous" pixel group accessed data. Further, by multiplexing the input from multiple framestores, pixels from one framestore may be made to "punch through" pixels from the other thereby producing a hardware "video rate" window or other effects.

The use of the state machine allows a unique processing (i.e. pixel data merging and manipulating) operation to be performed for each pixel group of pixel data to be displayed. Advantageously, these operations are carried out imperceptibly, at video rate, as the pixel group data is being routed from the framestore's to the display monitors DAC.

III. BRIEF DESCRIPTION OF THE DRAWINGS

The invention may be better understood by reference to the following drawings:

FIG. 1A and B is an overview of an embodiment of graphics/image processing hardware.

IV. DETAILED DESCRIPTION OF THE PREFERRED EMBODIMENTS

(1) Overview

Figure 1A:
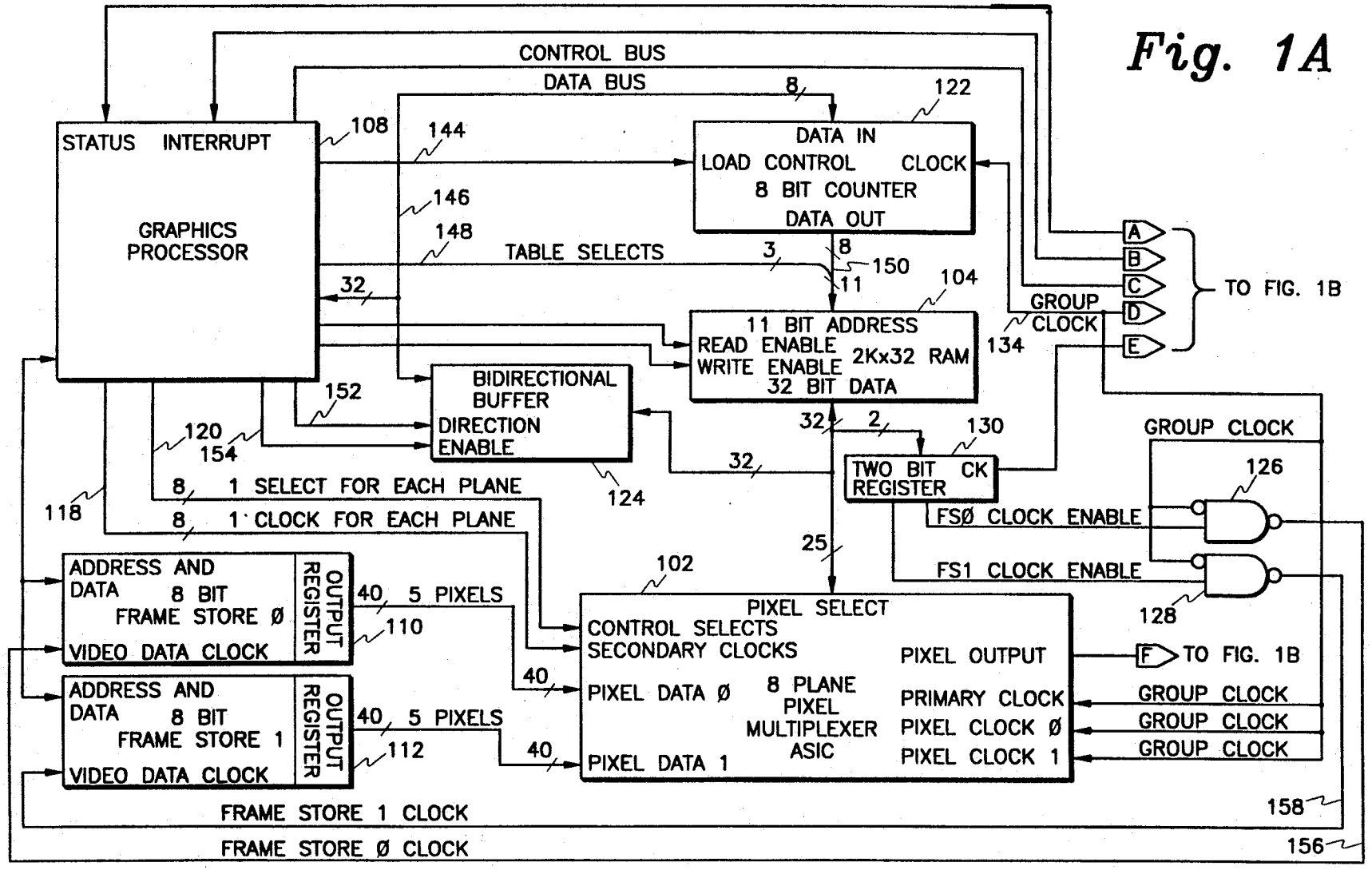

An overview of an embodiment of an image processing apparatus according to the invention and a proposed environment will now be described by reference to FIG. 1.

The apparatus preferably includes a pixel multiplexer 102 (preferably embodied in application specific integrated circuit) and a state machine, preferably in the form of a random access memory (RAM) 104. It is further preferred that RAM 104, (the control RAM), be a static RAM due to the relatively higher speed of static RAMs, (as compared with presently available dynamic RAMS). This apparatus preferably also includes a video timing generator 106, a graphics processor 108, two image/frame memories (framestores) 110, 112, a digital to analog converter (preferably a ramdac 114 for flexibility), and a display monitor 116. One suitable ramdac is a Bt461 chip manufactured by Brooktree Electronics, Inc, U.S.A.. The display monitor 116 is preferably a high speed/high resolution bit mapped display device.

Figure 1B:
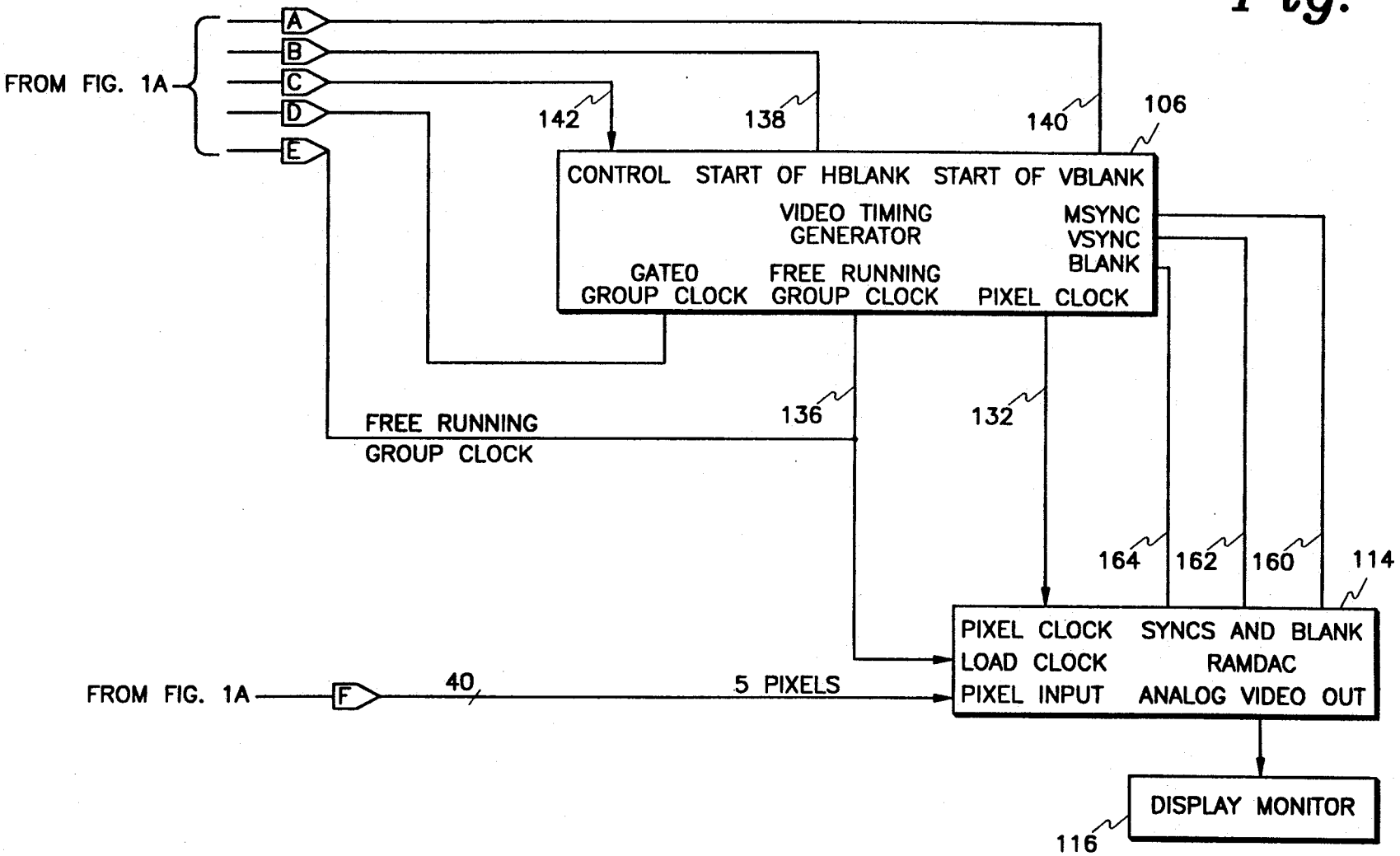

From FIG. 1, it may be seen that pixel multiplexer 102, manipulates pixel groups of pixel data from framestore0 110 and framestore1 112, under control of data stored within control RAM 104. A manipulated and reconstructed pixel group of pixel data is then output to ramdac 114 and displayed on display monitor 116.

It should be understood that FIG. 1 shows only one environment in which the invention may be used. For example, the invention may be used with only one framestore, or as part of a general purpose computer system. Further, the invention may be adapted for use in devices of specific application, e.g. ultrasonic imagery.

Figure 2:
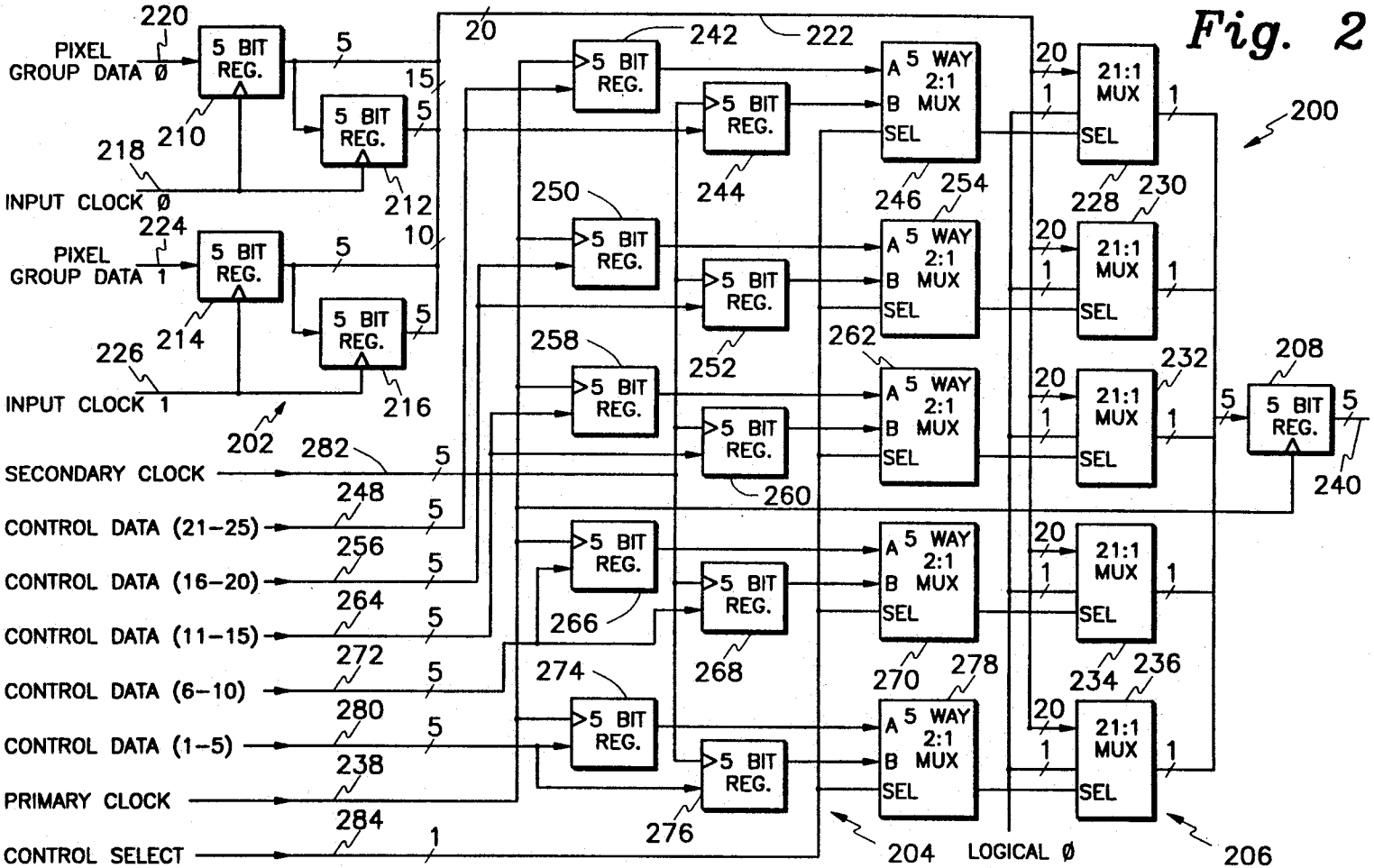
FIG. 2 is a drawing of a pixel multiplexer circuit

FIG. 2 shows the preferred embodiment of the pixel multiplexer circuitry for manipulating one pixel plane. A pixel plane is a one bit deep slice of the information used to define the pixels on a screen. For example, in a color system 8 bits of information might be used to define each pixel. A display screen may be visualized as being made up of an array of pixels, each defined by eight bits of information (e.g. in a 100×100 pixel screen there would be 10,000 pixels, each defined by eight bits of information). In order to operate on eight pixel planes, the circuitry of FIG. 2 would be duplicated eight times. As will be further explained, the pixel select lines, primary clock and pixel clock are shared between planes.

The circuit of FIG. 2 is preferably fabricated in a single application specific integrated circuit (ASIC) along with as many other of such circuits as are necessary to manipulate all of the pixel planes used by the imaging and graphics system (typically 8). At the present time, it appears that as many as eight of these circuits may be fabricated on one chip. It is contemplated by the inventors that fabrication technology will eventually remove this limitation. It should be understood that while fabrication on one chip is preferred, for speed and real estate efficiency purposes, the invention may also be fabricated through the use of discrete components.

(2) State Machine Controlled Video Processor (a) Pixel Multiplexer

The structure and operation of the pixel multiplexer will now be described by reference to FIGS. 1 and 2.

The pixel multiplexer circuitry of FIG. 2 is generally referred to by reference numeral 200. Typically, eight of these circuits would be used to process data on a system using eight pixel planes (i.e. eight bits of data to define each pixel). Preferably, all of these circuits are embodied in a single pixel multiplexer ASIC 102.

Each pixel multiplexer circuit 200 includes an input section 202, a control section 204, a multiplexer section 206, and an output register 208. The input section 202 serves as a pipe line and as temporary storage for pixel groups of pixel data coming in from the framestores 110, 112. The control section 204 serves as a pipeline for control information coming in from the control RAM 104. The multiplexer section 206, under control of control data supplied by the control RAM 104 via the control section 204, is used to select and route pixel data coming in from framestore0 110 and framestore1 112. The output register 208 collects the processed pixel data, output from the multiplexer section 206 and pipelines it to the ramdac 114 so that it may be displayed on the monitor 116.

i. The Input Section

The input section 202 comprises two pairs of 5 bit registers. The first pair of registers 210/212 are used to pipeline and temporarily store data from framestore0 110. The second pair of registers 214/216 are used to pipeline in data from framestore1 112.

Each pair of registers consists of an input register and a holding register. For purposes of clarity, the input register in the first register pair 210/212 will be referred to as the first input register 210. The holding register in the first register pair 210/212 will be referred to as the first holding register 212. Similarly, the input register in the second register pair 214/216 will be referred to as the second input register 214. The holding register in the second register pair 214/216 will be referred to as the second holding register 216.

Figure 3:
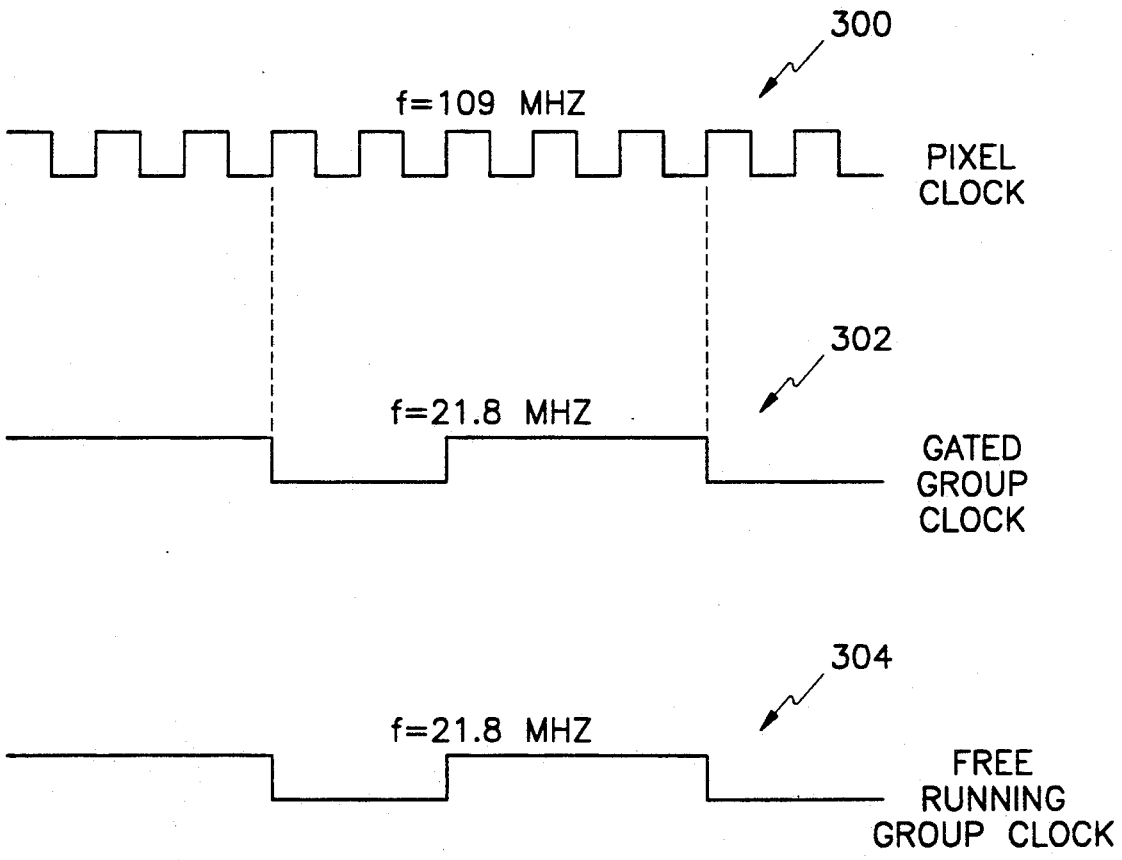
FIG. 3 is a diagram pixel group and pixel clock waveforms

In operation, the first input register 210 receives, in parallel, at its data inputs 220, 5 bits of pixel data from framestore0 110, each bit relating to a respective pixel in a group of five pixels in framestore0 110. The gated group clock 302 (FIG. 3) is connected to the clock inputs of the first pair of registers 210,212 via the input clock0 line 218. The gated group clock 302 is generated by the video timing generator 106 and is cycled once for every pixel group input to ramdac 114. The operation of the gated group clock and video timing generator will be described in more detail later.

Figure 11:
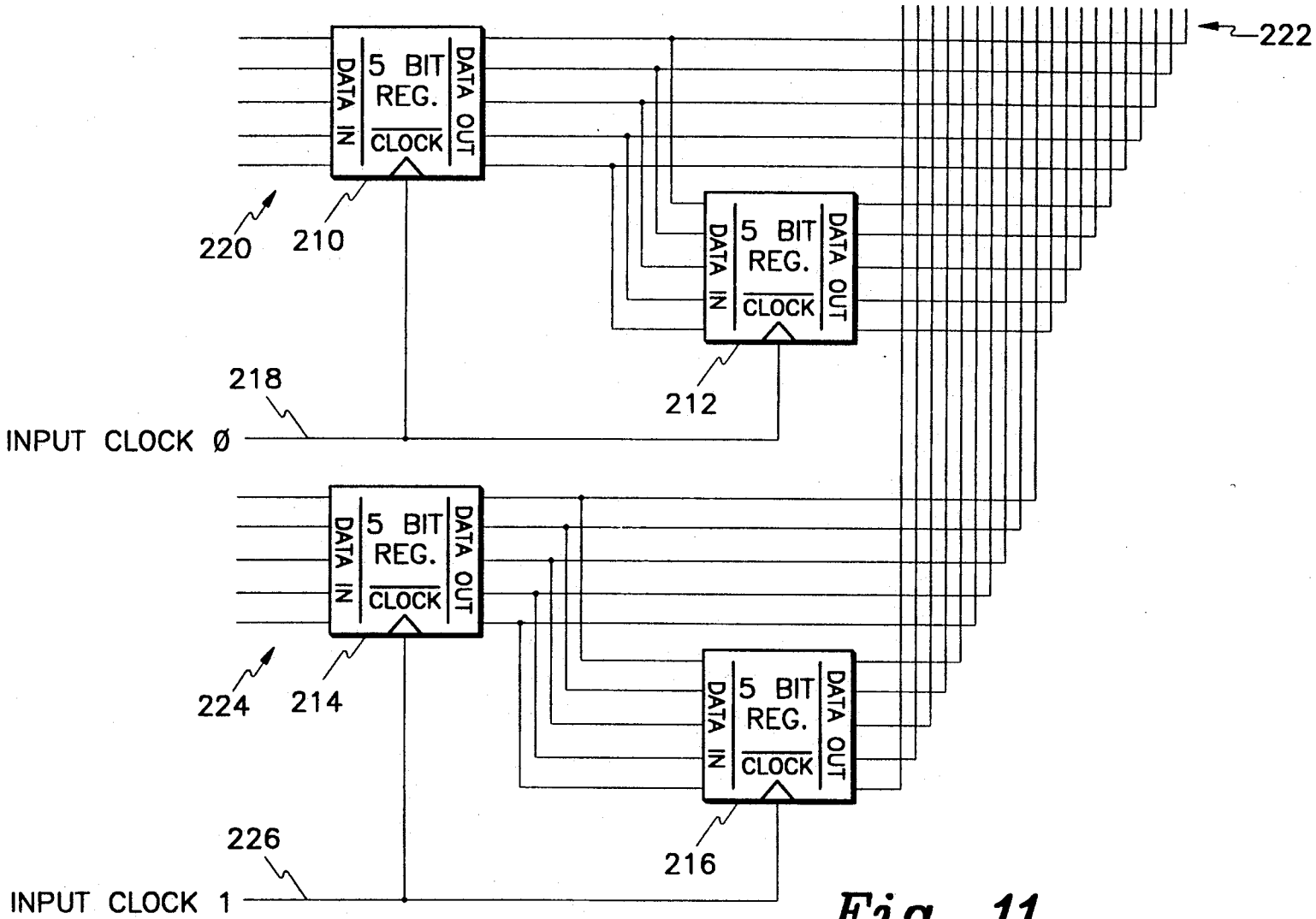
FIG. 11 is a magnified view of the pixel multiplexer circuitry, focusing on the area of attachment between the pixel bus and the input section.

On the first cycle of the gated group clock 302, a pixel group is read from framestore0 110 and appears at the data inputs 220 of the first input register 210. On the second cycle of the gated group clock 302 the pixel group at the data inputs 220 is loaded into the first input register 210 and appears at the data input of the first holding register 212 and on five lines of the pixel bus 222. Simultaneously, (assuming framestore0 is clock enabled), a new pixel group is read from framestore0 110 and appears at the data inputs 220 of the first holding register 210. If framestore0 110 is not clock enabled the pixel group at the first input register's data inputs 220 remains static. On the third cycle of the gated group clock 302, the "previous" pixel group, (which was in the first input register 210), is loaded into the first holding register 212 and appears at its output. On the same, (third), clock cycle, the "current" pixel group (framestore0 data which is now present at the data inputs 220 of the first input register register 210), is loaded into the first input register 210 and appears at its outputs. Simultaneously a new pixel group from framestore0 appears at the first input register's data inputs 220. The outputs of the first input register 210 and the first holding register 212 are kept separate and are used to provide five bits of data each to 20 bit pixel bus 222. The interconnection between the registers and the pixel bus may be better seen by reference to FIG. 11.

The second pair of registers 214, 216 operate in a similar manner. In operation, the second input register 214 receives, in parallel, at its data inputs 224, 5 bits of pixel data from framestore1 112, each bit relating to a respective pixel in a group of five pixels in framestore1 112. The gated group clock 302 (FIG. 3) is connected to the clock inputs of the second pair of registers 214, 216 via the input clock1 line 226. The gated group clock 302 is generated by a video timing generator 106 and is cycled once for every pixel group input to the ramdac 114.

On the first cycle of the gated group clock 302, a pixel group is read from framestore1 112 and appears at the data inputs 224 of the second input register 214. On the second cycle of the gated group clock 302 the pixel group of pixel data at data inputs 224 is loaded into the second input register 214 and appears at the data inputs of the second holding register 216 and on five lines of pixel bus 222. Simultaneously, (assuming framestore1 is clock enabled), a new pixel group is read from framestore1 112 and appears at the data inputs 224 of the second input register 214. If framestore1 112 is not clock enabled the pixel group data at the second input register's data inputs 224 remains static. On the third cycle of the gated group clock 302, the "previous" pixel group, (which was in second input register 214), is loaded into second holding register 216 and appears at its output. On the same, (third), clock cycle, the "current" pixel group (framestore1 data which is now present at the inputs 224 of the second input register 214), is loaded into the second input register 214 and appears at its outputs. Simultaneously a new pixel group from framestore1 112 appears at the second input register's data inputs 224. The outputs of the second input register 214 and the second holding register 216 are kept separate and are used to provide five bits of data each to 20 bit pixel bus 222.

In the preferred embodiment the input clock0 line 218 and the input clock1 line 226 are tied together and both driven, in common, by the gated group clock 302 (which will be further described later). It should be understood, however, that these input clock lines may also be driven independently, by separate and/or different clocks if the application requires.

From the foregoing description it may be seen, that by the end of the third clock cycle of the gated group clock 302, 20 bits of data appear on the pixel bus 222. These 20 bits of data consist of: the framestore0 "previous" data (5 bits), which is held in the first holding register 212; the framestore0 "current" data (5 bits), which is held in the first input register 210; the framestore1 "previous" data (5 bits), which is held in the second holding register register 216; and, the framestore1 "current" data (5 bits), which is held in the second input register 214.

On successive cycles of gated group clock 302, data from the first and second input registers 210, 214 is transferred to the first and second holding registers 212, 216 respectively. Simultaneously, data appearing at the data inputs of the first and second input registers 210, 214 is loaded into those registers. From this description it may be observed, that on each cycle of the gated group clock 302, the old "current" data becomes the "previous" data, while the data appearing at the data inputs of the first and second input registers 210, 214 becomes the new "current" data.

ii. The Multiplexer Section

Multiplexer section 206 comprises five, 21 to 1 multiplexers. The 20 bits of data from pixel bus 222 are fed, in parallel, to the inputs of each of the 21:1 multiplexers 228, 230, 232, 234 and 236. In other words, each of the 20 bits on pixel bus 222 appears as an input to each of the 21:1 multiplexers 228, 230, 232, 234 and 236. In the preferred embodiment, data bit 1 of the pixel bus will appear on the data1 input of each 21:1 multiplexer, data bit 2 of the pixel bus will appear as the data2 input of each 21:1 multiplexer and so on.

The select input of each of the 21:1 multiplexers receives data from control RAM 104 via control section 204. Depending on the control data that is made to appear at its select input, each of the 21:1 multiplexers may select any one of the 21 data bits appearing at its input, to appear at its output. It should be noted that while 20 bits of input data to each 21:1 multiplexer comes from pixel bus 222, the 21st bit of input data to each multiplexer is tied low (to a logical 0). The purpose for this will be explained later.

iii. The Output Register

Figure 12:
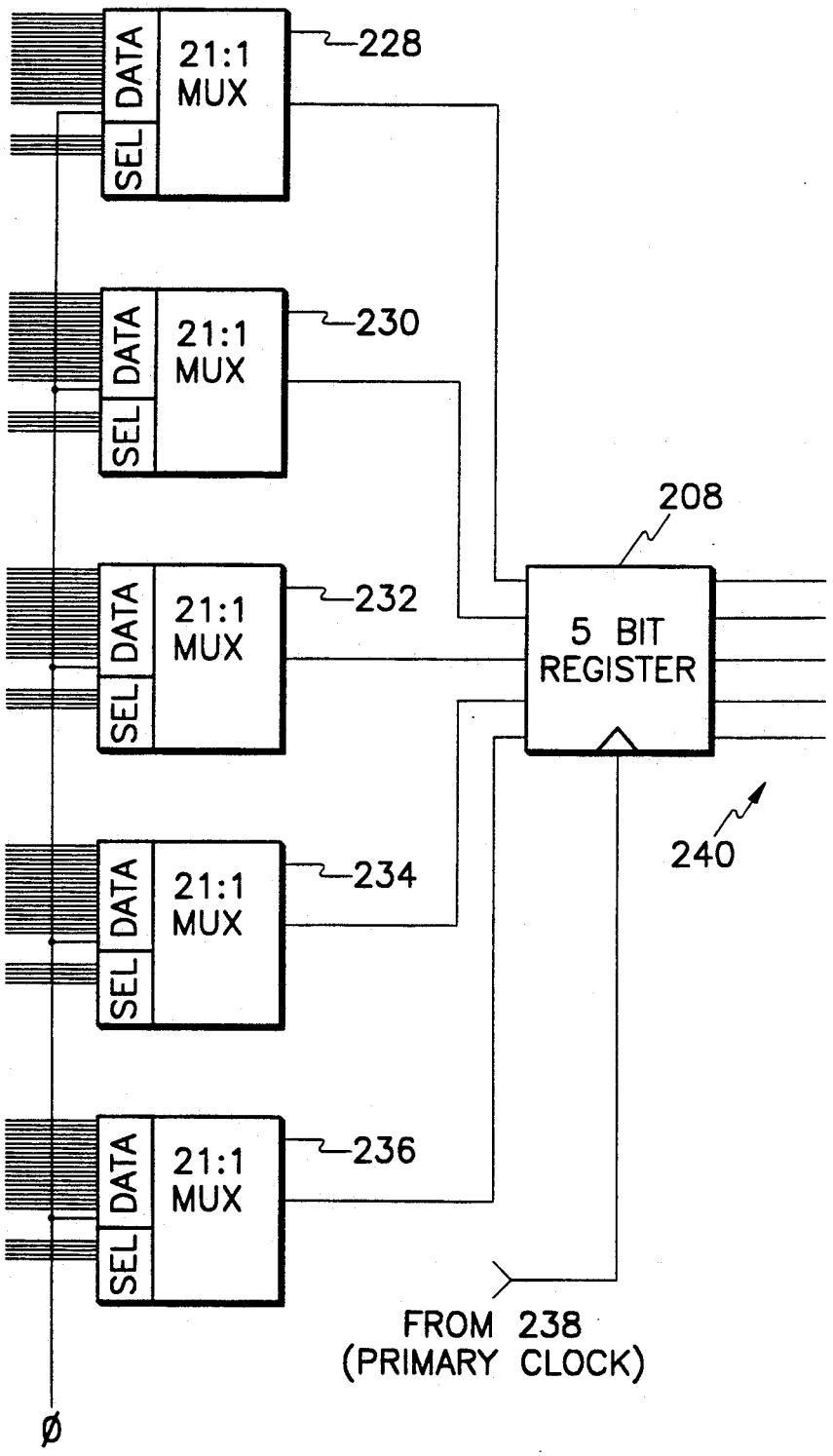
FIG. 12 is a magnified view of the pixel multiplexer circuitry, focusing on the area of attachment between the outputs of the 21:1 multiplexers and the output register.

Output register 208 is a preferably a 5 bit register. It receives at each of its five inputs, one bit of data from the output of a respective one of the 21:1 multiplexers 228, 230, 232, 234 and 236. The clock input of the output register 208 is tied to the primary clock input 238 (as are the clock inputs to registers 210, 212, 214 and 216). As has been explained, the primary clock input 238 is preferably connected to the gated group clock 302 via line 134. The interconnection between the 21:1 multiplexers and the output register 208 may be better seen be reference to FIG. 12.

On the first three cycles of the gated group clock 302, no meaningful data is clocked into register 208. On the third, and subsequent cycles of the gated group clock 302, pixel group data from the combined outputs of 21:1 multiplexers 228, 230, 232, 234 and 236 is loaded into register 208 and the processed pixel group data appears at its output 240. In cases where a merge operation is to be performed, valid data is first loaded into register 208 on the fourth cycle of the gated group clock 302. When the pixel group of merged data appears at the output of register 208 it is fed into ramdac 114 and the corresponding image appears as pixels on display monitor 116.

iv. The Control Section

Control section 204 comprises five sets of subcircuits, one for each of the 21:1 multiplexers. Each subcircuit includes 2 registers and one 5 way, 2:1 multiplexer. The structure of the control section subcircuits will now be described.

The first subcircuit includes a primary control register 242, a secondary control register 244, and a 5 way 2:1 control multiplexer 246. Each of the primary and secondary control registers 242, 244 are five bits wide. The reason that five bit registers are used is so that a sufficient amount of select bits can be pipelined from the control RAM 104 to the 21:1 multiplexers in multiplexer section 206. The input lines of the primary and secondary control registers 242, 244 are connected in parallel so as to receive, at a common input 248, a first five bit group of control data, (control word bits 21–25), from the control RAM 104.

The second subcircuit includes a five bit primary control register 250, a five bit secondary control register 252 and a 5 way 2:1 control multiplexer 254. The input lines of the primary and secondary control registers 250, 252 for the second subcircuit are connected in parallel so as to receive, at a common input 256, a second five bit group of control data, (control word bits 16–20), from the control RAM 104.

The third subcircuit includes a 5 bit primary control register 258, a five bit secondary control register 260, and a 5 way 2:1 control multiplexer 262. The input lines of the primary and secondary control registers 258, 260 for the third subcircuit are connected in parallel so as to receive, at a common input 264, a third five bit group of control data, (control word bits 11–15), from the control RAM 104.

The fourth subcircuit includes a 5 bit primary control register 266, a five bit secondary control register 268, and a 5 way 2:1 control multiplexer 270. The input lines of the primary and secondary control registers 266, 268 for the fourth subcircuit are connected in parallel so as to receive, at a common input 272 a fourth five bit group of control data, (control word bits 6–10) from the control RAM 104.

The fifth subcircuit includes a 5 bit primary control register 274, a five bit secondary control register 276, and a 5 way 2:1 control multiplexer 278. The input lines of the primary and secondary control registers 274, 276 for the fifth subcircuit are connected in parallel so as to receive, at a common input 280 a fifth five bit group of control data, (control word bits 1–5), from the control RAM 104.

All five subcircuits share, in common, a control select input 284, a secondary clock input 282 and a primary clock input 238. Each of the five subcircuits receives a different five bits of control data from control RAM 104. The grouping of the control data will be explained later and can be seen by reference to table 1-1 (within).

The operation of control section 204 will now be explained. Prior to clocking in frame data, (at each vertical blank period), secondary control registers 244, 252, 260, 268 and 276 are loaded with a "default" control value. This is accomplished by the graphics processor 108, (during the vertical blank period of the display monitor 116), by clocking in default data from the control RAM 104 using one of its secondary clock lines 118. It should be understood that the graphics processor 108 preferably provides a separate secondary clock to each multiplexer circuit 200, (one multiplexer circuit is used for each pixel plane), through secondary clock input 282.

In the preferred embodiment, the "default" control value preferably consists of control data which will cause pixel groups from framestoreo to pass through the pixel multiplexer in "raw", unmanipulated format. In other words, pixel groups from framestore0 will appear at the data outputs of the output register 208 in the same form and order that it appeared at the data inputs of the first input register 210, while the data from framestore1 will not be used. Alternatively, default control data may be chosen so as to cause pixel groups from framestore1 112 to pass through the pixel multiplexer circuit unmanipulated. It should be understood that any "default" control data may be chosen, depending on the application.

Beginning on the third cycle of the gated group clock 302, valid control data from the control RAM 104 is loaded into the primary control registers 242, 250, 258, 266 and 274. The control select input 284 is preferably set during each vertical blank period and held static between vertical blanks. If desired, however, it may also be changed during the horizontal blank period. Any changing of the control select line during a scan of the display monitor will be likely to cause artifacts on the display screen.

As can be observed from FIGS. 1 and 2, the select inputs of each 5 way, 2 to 1 multiplexer 246, 254, 262, 270 and 278 are all tied to the control select input 284. The control select input is in turn tied to one of the eight control select lines 120 provided by the graphics processor 108. The state of the control select input 284 determines whether the control data, which eventually appears at the select inputs of the 21:1 multiplexers is the default data (from the secondary control registers 244, 252, 260, 268 and 276), or primary control data (from the control RAM 104 via primary control registers 242, 250, 258, 266 and 274). It should be understood that the primary control registers may be reloaded with new control data from control RAM 104 on each cycle of the gated group clock, while the data within the secondary control registers preferably remains static for the entire display monitor refresh cycle (i.e. the period between vertical blanks).

By then end of the third cycle of the gated group clock 302, the selected control data has appeared at the select inputs of the 21:1 multiplexers 228, 230, 232. 234 and 236. By the end of the fourth cycle of the gated group clock the bit selected by this data appears at the output of each 21:1 multiplexer and is ready to be loaded into the output register 208.

v. The State Machine Circuit

A state machine in the form of control RAM 104 is shown in FIG. 1. As has been stated, control RAM 104 is preferably a static RAM (for speed purposes). It should be understood that control RAM 104 is just one possible state machine and that any other type of RAM or any other type of state machine may be used in its place where the application permits. The control RAM support circuitry includes an 8 bit counter 122, a bidirectional buffer 124, two AND gates 126, 128, and a two bit register 130.

It may be observed from FIG. 1, that the video timing generator 106 provides at least three clocks. These are the pixel clock 300, (on line 132), the gated group clock 302 (on line 134), and the free running group clock 304 (on line 136). The pixel clock 300 is cycled at video rate (e.g. 109 MHZ). The free running group clock 304 and gated group clock 302 are cycled once for every pixel group output to ramdac 114. The difference between the gated and free running group clocks is that the gated group clock 302 may be stopped and restarted on command while the free running group clock 304 perpetually cycles. All clocks run at a constant rate. Both group clocks 302, 304 will run at the pixel clock frequency divided by the number of pixels in each pixel group. In the embodiment tested by the inventors the group clocks were set at 21.8 MHZ, which was calculated as 109 MHZ (video rate)/ 5 (the number of pixels defined in each pixel group). As can be seen from FIG. 3, the group clocks are asymmetrical. The high portion of the cycle lasts for three cycles of the pixel clock 300, while the low portion of the group clock cycle lasts for two cycles of the pixel clock. The asymmetrical nature of the group clocks is a function of the manner in which the pixel clock is divided by five. Where an even number of pixels are represented in each pixel group the group clocks will be symmetrical. The purposes of the separate gated and free running group clocks will be explained later.

As can be seen from FIG. 1, both the free running group clock 304 and pixel clock 300 are used as inputs to the ramdac 114. The free running group clock 304 is used by the ramdac 114 to clock in pixel groups coming from the pixel multiplexer 102. The pixel clock 300 is used to clock individual pixel data from the ramdac 114, to the display monitor 116 as an analog output.

The free running group clock 304 also serves another important purpose. It is used as the clock input to the two bit register 130. The two bit register 130 is used to hold the 2 bits of clock enable data from the control RAM 104. In order to ensure that the clock enable data is stable at the framestores at the correct time in vertical blank period, the free running group clock is used to load the 2 bit register as opposed to the gated group clock. This aspect of the free running group clock will be discussed in more detail in section IV(6) of this specification.

The gated group clock 302 also serves several important purposes. It is used to clock the 8 bit counter 122, it is used as the primary clock of the pixel multiplexer 102, it used as both the pixel input 0 and pixel input 1 clocks of pixel multiplexer 102, and it is also used to clock data out of the framestores 110, 112.

The eight bit counter 122 counts down during a line display, by counting the edges of the gated group clock 302. The counter 122 can be loaded asynchronously by the graphics processor 108. The counter 122 is also used for loading and reading the control RAM 104.

The control RAM 104 is preferably a 2K×32 bit static random access memory (SRAM). Control RAM 104 controls the flow of data between the framestores 110, 112 and the ramdac 114 during active display time. By using a RAM, (control RAM 104), as the state machine, a number of zoom, pan, and hardware window effects can be created on the screen.

In an embodiment tested by the inventors control RAM 104 was designed using four 2K×8 bit SRAMS. In this configuration the higher order five data bits are unused but are available for later modifications to the pixel multiplexer 102. The counter 122 is preferably an eight bit counter with the ability to have an initial value loaded. This, type of counter gives the system designer a broad choice of programing options.

From FIG. 1 it may be seen that the 8 lower order address bits of the control RAM 104 are provided by the output of the 8 bit counter 122. The 3 higher order address bits are provided by the graphics processor 108. Advantageously, this configuration allows for each pixel group in a displayed line to be uniquely controlled. Control RAM 104 can be considered to hold 8 tables of 256 control words in length, each control word being 27 bits wide, (currently, 5 data bits out of the 32 provided are not used). The format of the 27 bits within each control word will be explained in more detail later. Advantageously, the eight different tables can be used to store different line configurations. A different table can be selected, instantaneously, on a line by line basis, under control of the 3 higher order address bits from the graphics processor 108.

The actual size of the control RAM 104 and the number of address bits used may be modified depending on the specific display monitor or application which is chosen. For example, in an embodiment tested by the inventors, display monitor 116 was a standard high resolution bit mapped display having 1280 pixels across each horizontal scan line. Video rate for the tested monitor was about 109 MHZ and the video RAMS were clocked at about 21.8 MHZ. Using this system, each pixel group accessed from frame memory consisted of data representing 5 pixels (i.e. 109/21.8). In order to store unique control data for each pixel group (5 pixels) to be displayed on one horizontal scan line of the monitor, 256 (i.e. 1280/5) memory locations must be provided. The inventors have discovered that for the vast majority of applications no more than 8 of such tables will be needed to process data for any one frame. Therefore a 2K (256×8) RAM was chosen to store the control data. It takes 3 bits of data to address 8 tables (the higher order bits). Therefore, 3 bits of address data are provided by the systems graphics controller. It takes 8 bits of data to address 256 memory locations (the lower order bits). Therefore, an eight bit counter was utilized for counter 122. In other words, the system preferably includes eight, 256 location×27 bit tables to handle a, presently standard, high resolution bit mapped display monitor.

Advantageously, in accord with the above principals, the invention is easily modified to work efficiently in varying applications, and to keep up with changing technology. Some of the general formulas used above are as follows:

For the size of each access pixel group, $P=M/V$, where P is the pixel group size (i.e. the number of pixels represented by the data in each pixel group), M is the clock rate of the display monitor (video rate), and R is the rate at which the video RAMS, (or any other devices used for frame memory), are clocked;

For the minimum size of each control table, $CT=H/P$, where CT is the number of locations needed to store unique control information for each pixel group in a horizontal scan line, H is the number of pixels display in each horizontal scan line, and P is the pixel group size (as calculated above).

For the total size of the control RAM, $S=CT \times N$, where S is the size of the control RAM used (i.e. the number of memory locations), CT is the size of each control table, and N is the number of tables the system designer or programer wishes to store for each displayed screen (one complete scan of the display monitor).

As has been stated, the number of tables used to draw a complete screen is preferably 8. This may be varied up or down, however, depending on physical design constraints or the specific application. The number of higher order address bits coming from the graphics controller will, of course, depend on the number of tables utilized. The number of lower order address bits, and the size of counter 122, will be determined by the number of entries in each table.

In the preferred embodiment, 8 bit counter 122 counts down from 255, (hex FF), on every cycle of the gated group clock 302 thereby causing the lower order 8 address bits of the control RAM 104 to be decremented. Advantageously, this causes a unique data location of control RAM 104, and the control data within, to be addressed for every one of the 256 pixel groups in a horizontal scan line. The control data appears on the data outputs of the control the RAM 104 and is used to control the operation of the pixel multiplexer 102, and to disable or enable the framestore clocks for each pixel group of data to be displayed on the display monitor 116.

The preferred operation of graphics processor 108 will now be described. Before the beginning of each horizontal scan of display monitor 116, the graphics controller selects a table from control RAM 104 by setting the control RAMs three higher order address bits 148. The address data may be changed, and a new table selected, during the horizontal blank period of monitor 116 (i.e. the period between the end of one horizontal scan line and the beginning of the next). By changing the tables during the horizontal blank period, the changes in the control table do not interfere with the display of pixel information. It should be understood that the programer may choose to change or not to change the selected control table between the display of horizontal lines (i.e. the same table may be used for many lines). The graphics processor 108 preferably makes the decision to change tables and takes any required action responsive to horizontal blank interrupt from video timing generator 106 on line 138. Further, during the vertical blank period, (the completion of one full image screen being drawn), graphics processor may reload the control RAM 104 with an entirely new set of control tables. A software or microcode routine to accomplish this function is preferably entered at the start of the vertical blank period.

The vertical blank period is preferably detected by reading the status line 140 of video timing generator 106. Every time video timing generator 106 generates a horizontal blank interrupt on line 138, it also updates the status on the status line 140. Responsive to a horizontal blank interrupt on the horizontal blank interrupt line 138, the graphics processor 108 reads the status line 140 of the video timing generator 106 to determine whether the vertical blank time has arrived. It should be understood that other types of interrupt generating circuits may be used in the place of video timing generator 106 as long they provide an indicator for at least the horizontal blanks and some kind of indicator for the beginning of at least the first vertical blank.

For example, by using a counter in either software or hardware the graphics processor can keep track of horizontal blank interrupts. As long as it knows how many scan lines are displayed on monitor 116 it can determine when the vertical blank period has occurred by determining when the number of horizontal blank interrupts equals the number of scans. As another example, a hardware counter or other means can be used to generate two separate interrupts, one for the vertical blank and one for the horizontal blank.

The loading of control data into the control RAM 104 will now be described in detail. In order to load control RAM 104, the eight bit counter 122 is used to supply the control RAMs eight lower order address bits 150. In order to accomplish this, the gated group clock 302 (on line 134) must be halted. The loading of control RAM 104 is accomplished during the vertical blank period so as to prevent screen disturbances.

To start the control data load cycle, graphics processor 108 first turns off the gated group clock 302 (on line 134) by sending the appropriate control data along the timing control bus 142 to video timing generator 106. Once the gated group clock 302 has been stopped, the 8 bit counter 122 is initialized to the desired starting address (preferably hexadecimal "FF"). In order to accomplish the eight bit counter initialization, the graphics processor 108 asserts a load signal on the load control line 144 and asserts the initial counter value on data bus 146. Next, after the 8 bit counter 122 has been initialized, the graphics processor 108 sets the three higher order address lines of the control RAM 104 for the desired table, read disables the control RAM 104, sets the direction line 152 of the bidirectional buffer 124 so that data will flow from bus 146 to control RAM 104, and enables the bidirectional buffer 124 through its enable line 154. The graphics processor 108 then write enables the control RAM 104 and loads it with control data passed through from bidirectional buffer 124. Graphics processor 108 then turns back on the gated group clock 302 for one clock pulse thereby decrementing 8 bit counter 122. The next address in the selected control table is then loaded. The process is repeated for each address within each table that is to be loaded.

Once control RAM 104 has been loaded, the 8 bit counter 122 is reinitialized, the bidirectional buffer 124 is disabled, the three higher order address bits are set to the desired control table address for the first line to be displayed and the gated group clock 302 is restarted.

Advantageously, the graphics processor 108 can increment the counter 122 while writing to the control RAM 104 thereby increasing the speed at which control tables can be loaded. The graphics processor 108 can also read the control RAM 104 by enabling the bidirectional buffer 124 in the direction from the control RAM 104 to the graphics processor 108 and read enabling the control RAM 104.

The system can load the entire control table into the control RAM 104 and be ready to process pixel group information in less than 500 microseconds (a typical vertical blank period). Further, the system can readdress the control RAM 104 and have the data from new control table stable and available for the control sections of the pixel multiplexer 102 in less than 3 microseconds. In any event, the system should be designed to perform these functions within the appropriate blank periods.

The graphics processor 108 also provides several important signal lines to the pixel multiplexer 102. These are the eight secondary clock lines 118, and eight control lines 120. The operation of the secondary clock has been explained in the "control section" portion of this specification. Assertion of a control select signal on control select input 284 will cause the selected pixel multiplexer circuitry 200, within pixel multiplexer 102, to ignore data coming from the control RAM 104 and instead process pixel group information under control of default data stored in the secondary control registers 244, 252, 260, 268 and 276 for the selected plane (shown in FIG. 2).

The advantages of the control select lines are more apparent when the invention is conceived of as containing one multiplexer circuit 200 for each plane of pixel information, each planes circuitry having its own separate control select line. For example, assume that each pixel position is defined by eight bits of data. Seven of those bits are used to define the colors of pixels that make up an image and one of those bits is used to define a text and/or graphic overlay displayed on monitor 116. If one desires to magnify the image without magnifying the displayed overlay, seven of the multiplexer circuits may do so, under control of the information stored in control RAM 104, while the 8th multiplexer circuit would receive a positive control select signal which would cause the overlay to be drawn in unmagnified form, under control of control data stored in the secondary control registers 244, 252, 260, 268 and 276.

The format of the control data stored in the control RAM 104 will now be discussed by reference to FIG. 2 and the tables below. The control RAM 104 stores 8 tables of 256, 27 bit control words. In actuality, each control word is 32 bits wide but the last 5 bits are unused. The two most significant bits of the each control word are used to enable (high) or disable (low) the clocks for framestores 0 and 1 respectively. The next 25 bits are broken up into five groups of five bits. Each group of five bits is used to provide control data to each of the 21:1 multiplexers 228, 230, 232, 234 and 236, through each multiplexers corresponding control circuit. The most significant bit in each five bit field is used to select between framestore0 and framestore1 (i.e. this bit determines whether the bit that appears at the output of the 21:1 multiplexer will come from framestore 0 or framestore 1). In the preferred embodiment a "0" will cause framestore 0 to be selected and a "1" will cause framestore1 to be selected. The next most significant bit is used to choose between the "current" pixel group data (in register 210), and the "previous" pixel group data (in register 212). In the preferred embodiment, a "0" in this position will select the "previous" pixel group data and a "1" will select the current pixel group data. The next 3 bits are used to select data for any one of the five individual pixels within the selected pixel group data.

The use of the 3 "pixel position select bits" will now be explained in detail. Each pixel group output to the display may thought of as having five pixel positions: A,B,C,D,E. The table below, shows how the output of each 21:1 multiplexer in FIG. 2 corresponds to a particular output pixel group position.

Multiplexer 228—position A
Multiplexer 230—position B
Multiplexer 232—position C
Multiplexer 234—position D
Multiplexer 236—position E In addition, each input pixel group may be thought of as being similarly organized into five positions, A,B,C,D,E. In the preferred embodiment, the following binary control inputs, (on the lower order three bits of control data), will cause the controlled 21:1 multiplexer to select, from the chosen input pixel group, the corresponding output pixel group position.

000—select input pixel A
001—select input pixel B
010—select input pixel C
011—select input pixel D
100—select input pixel E
101—select 0

In the preferred embodiment, the first 256 word table in control RAM 104 is always loaded with control data that will select the "current" pixel group from framestore0, and cause every pixel within each input pixel group from framestore0 to be output to it corresponding position (i.e. data that comes in as ABCDE will go out as ABCDE). Similarly, the second table is preferably loaded with data that will select the "current" pixel group from framestore1 and output the pixel group data in unmanipulated form. This allows the data from framestore0 110 or framestore1 to be output in straight unpanned, unzoomed and unmanipulated form without the need to download new tables each time either framestore is displayed unpanned or unzoomed.

It should be noted that the three available bits may potentially represent 8 binary combinations, whereas only five are needed to select among the five pixels. One of these combinations may be used to force the output of the 21:1 mux to a "low" state so as to force that pixel position to be displayed as black or any other color defined as a 0 in the ramdac 114.

The application and operation of the two higher order bits of the control RAM 104 will now be explained by reference to FIG. 1. From FIG. 1, it may be seen that the two higher order bits of data from the control RAM 104 are used as enables for the output clocks of framestore0 and framestore1. These two bits (27 and 26) are clocked through a two bit register 130 and are sent to the input of the two modified AND gates 126, 128. The most significant data bit (bit 27) from the control RAM 104 is logically ANDed, (at a first modified "AND" gate 126), with the gated group clock line 134. The output of the first "AND" gate 126 is used as the data clock for framestore0 at line 156. The next most significant bit (bit 26) is also ANDed, (at a second modified "AND" gate 128), with the gated group clock line 134. The output of the second modified "AND" gate 128 is used as the data clock for framestore1 at line 158. Advantageously, this circuit allows control data from control RAM 104 to cause the same framestore data from either or both framestores to remain at the inputs to registers 210 and/or 214 for more than one cycle of the gated group clock 302. This is particularly useful for the magnification (or "zoom") operation.

The two bit register 130 and the free running group clock are very significant from the standpoint of timing. As has been explained, the control RAM 104 is loaded during the vertical blank period. As part of this loading cycle, the gated group clock 302 is stopped. By the time the vertical blank period is over, and before the gated group clock is reenabled, the clock enable bits for the framestores must already have been read from the first control word and must be stable at the inputs to the modified AND gates 126, 128. This is more clearly understood when it is realized that the gated group clock is restarted just before the first control word is read from the control RAM 104. In order for the modied AND gates to have any valid effect, the clock enable bits (27 and 26) must be present and stable at the inputs of the modified AND gates before the gated group clock appears. The modification of the AND gates involves inverting the free running group clock inputs and the AND gate outputs serve to prevent glitches on the framestore video data enable lines. By using the free running group clock to load these two bits into the two bit register 130, before the gated group clock is restarted, it is ensured that the framestores will be properly enabled or disabled for the first words of control data.

The table below, shows how each of the 27 bits in each control word are utilized. From this table it should be understood that any one of the data bits appearing on the pixel bus 222 may, (under control of control data from the control RAM 104), be made to appear at any of the five output positions in each pixel group. Further, it may be seen that any given data bit may also be made to appear at more than one output position. Every possible permutation of 5 output bits chosen from the group 20 input bits may be selected. Translated into pixels, this means that any pixel defined within any of the "current" framestore0, "previous" framestore0, "current" framestore1, and "previous" framestore1, may be made to appear at any, (including more than one of), of the five positions in pixel group to be displayed on monitor 116. In addition, any output pixel position may be made to appear as a color predefined in the ramdac 114 as all zero's.

TABLE 1-1

CONTROL WORD ORGANIZATION

| Bit Number | Purpose | Programming |
|---|---|---|
| 27 (MSB) | clock enable for framestore0. | 0 = disabled<br>1 = enabled |
| 26 | clock enable for framestore1. | 0 = disabled<br>1 = enabled |
| 25 | framestore select for pixel position 'A'. | 0 = framestore0<br>1 = framestore1 |
| 24 | current/previous pixel group (position A). | 0 = previous<br>1 = current |
| 21-23 | input pixel position select for output pixel group position 'A' (i.e. 21:1 MUX 228). | 000 - input A<br>001 - input B<br>010 - input C<br>011 - input D<br>100 - input E<br>101 - zero |
| 20 | framestore select for pixel position 'B'. | 0 = framestore0<br>1 = framestore1 |
| 19 | current/previous pixel | 0 = previous |

TABLE 1-1-continued

| CONTROL WORD ORGANIZATION | | |
|---|---|---|
| Bit Number | Purpose | Programming |
| | group (position B) | 1 = current |
| 16–18 | input pixel position select for output pixel group position 'B' (i.e. 21:1 MUX 230). | 000 - input A<br>001 - input B<br>010 - input C<br>011 - input D<br>100 - input E<br>101 - zero |
| 15 | framestore select for pixel position 'C'. | 0 = framestore0<br>1 = framestore1 |
| 14 | current/previous pixel group (position C) | 0 = previous<br>1 = current |
| 11–13 | input pixel position select for output pixel group position 'C' (i.e. 21:1 MUX 232). | 000 - input A<br>001 - input B<br>010 - input C<br>011 - input D<br>100 - input E<br>101 - zero |
| 10 | framestore select for pixel position 'D'. | 0 = framestore0<br>1 = framestore1 |
| 9 | current/previous pixel group (position D). | 0 = previous<br>1 = current |
| 6–8 | input pixel position select for output pixel group position 'D' (i.e. 21:1 MUX 234). | 000 - input A<br>001 - input B<br>010 - input C<br>011 - input D<br>100 - input E<br>101 - zero |
| 5 | framestore select for pixel position 'E'. | 0 = framestore0<br>1 = framestore1 |
| 4 | current/previous pixel group (position E). | 0 = previous<br>1 = current |
| 1–3 | input pixel position select for output pixel group position 'E' (i.e. 21:1 MUX 236). | 000 - input A<br>001 - input B<br>010 - input C<br>011 - input D<br>100 - input E<br>101 - zero |

The interconnection between multiple pixel multiplexer circuits 200 so as to form a multiplane pixel multiplexer 102 will now be described by reference to FIGS. 1 and 2. When more than one pixel plane is to be processed, one multiplexer circuit is preferably used for each plane. In order to accomplish this, data inputs 220 and 224 of registers 210 and 214 are each connected to a one bit deep plane of pixel group data from their respective framestores (i.e. each multiplexer circuit processes a 5 bit wide by 1 bit deep pixel group of information from each framestore). All of the input clocks 218, 226, and primary clock inputs 238, on all multiplexer circuits, are tied to the gated group clock 302 through the gated group clock line 134. Further, the 21:1 MUXs, for each pixel position, share across the defined pixel planes, the same 5 bit field of control data from control RAM 104.

The sharing of five bit control fields may be better understood by looking at table 1-1 above. Every position A, 21:1 multiplexer 228 shares a first five bits of control data (bits 21–25), every position B, 21:1 multiplexer 230 shares a second five bits of control data (bits 16–20), every position C, 21:1 multiplexer 232 shares a third five bits of control data (11–15), every position D, pixel multiplexer 234 shares a fourth five bits of control data (6–10), and every position E, 21:1 pixel multiplexer 236 shares a fifth 5 bits of control data (1–5).

Each control section 206 for each plane has independent secondary clock line 118 and an independent control select line 120 from the graphics processor 108.

(3) State Machine Controlled Pan

The Memory Controlled Pan operation will now be described by reference to FIGS. 4,5,6, and 7. The Pan operation is accomplished by using a combination of state machine controlled video hardware and graphics processor software.

A "pan" is an image manipulation operation through which an image is shifted in either direction along the horizontal "X" axis of the display monitor. This pan operation is to be distinguished from a "scroll" which involves shifting an image along the vertical or "Y" axis of the display monitor. Pan and scroll operations may be performed on the same image (i.e. an image may be shifted up and to the left), however, the mechanisms that allow these to operations to be accomplished are often distinct.

In systems which access pixel data in pixel groups, the pan operations poses special problems. To illustrate these problems the example of an image that is to be shifted one pixel length to the left will be used. In an older, non pixel group access systems, shifting by one pixel length created no special problems. All that had to be done was to begin sending data to the monitor starting at the second address and either throw away, or wrap around (a term that will be explained later) the first piece of pixel data to be displayed on each horizontal line. Unfortunately, this does not work in a pixel group access system. Because pixel data is accessed in groups (e.g. five at a time), not using the first pixel group will result in the image being displayed offset by one full pixel group (e.g. 5 pixels) as opposed to just one pixel. A similar problem occurs when one desires to move a window from one position on the monitor to another. In a typical many prior systems, the best that a programmer could do was to move the image to a pixel group boundary. The image could not be simply shifted over by one pixel.

Figure 4:
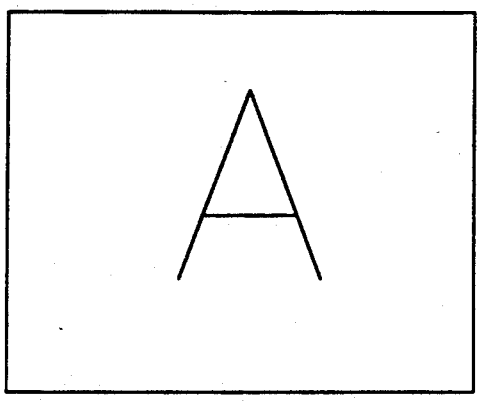
FIG. 4 is a diagram of an unpanned letter "A."
Figure 5:
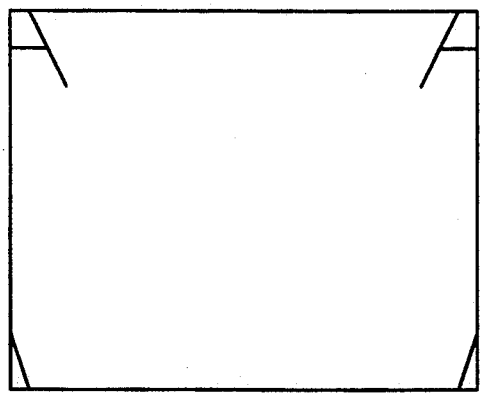
Fig. 5 PRIOR ART
FIG. 5 is a diagram of a panned/scrolled letter "A" operation with wrap-around.
Figure 6:
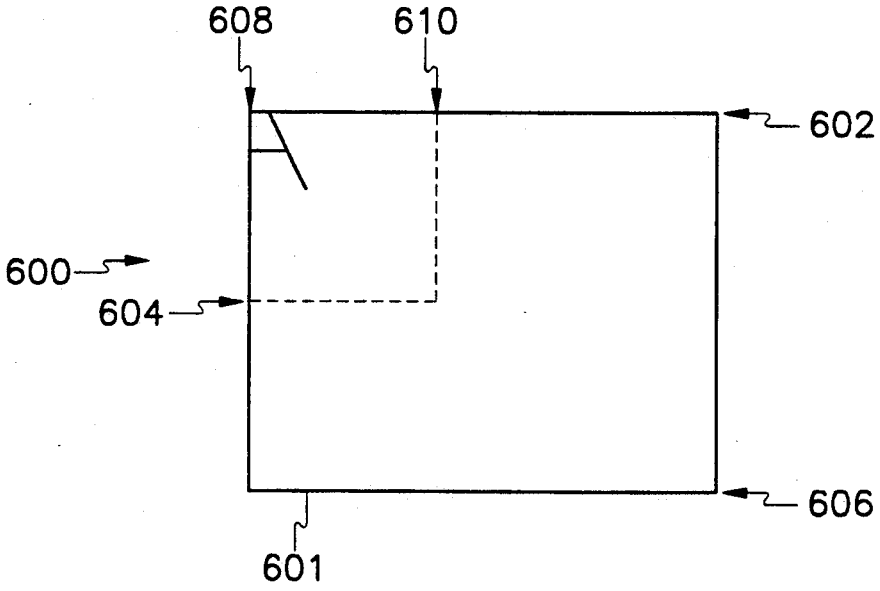
FIG. 6 is a diagram of a panned/scrolled letter "A" operation with border color pixel fill.

Previous systems may also have another problem with the pan operation which is illustrated by reference to FIGS. 4, 5 and 6. FIG. 4 shows the letter "A" in the center of a display monitor. If the image of FIG. 4 were to be shifted to the left for example) some kind of data would need to "fill in" the pixels left empty on the right hand side of the screen.

Typically, two methods have been used to deal with this problem. The first method involves "wrapping around" the image. This is illustrated by FIGS. 5. If the image of FIG. 4 were to be scrolled and panned up and to the left, the parts of the image which have moved off one side of the monitor would simply be made to appear on the opposite side of the monitor this is illustrated by FIG. 5. This technique, while easy to accomplish, does not provide what a person would expect to see if a real object were to be panned in the view finder of a movie camera for example. Another method sometimes used to deal with this problem is to have a frame memory which stores more information than can be displayed on the monitor. Using this method, as an image is shifted of the screen, other image data, previously unseen, appears in its place. The problem with this method is that no memory is infinite. Eventually the contents of available memory will be panned off the screen and the problem of filling in vacant pixel positions will still be there.

By using the pixel multiplexer 102 and the control RAM 104, the present invention resolves the above described problems. As may be observed by reference to FIG. 6, the invention resolves the "wrap around"

problem by using two different tables in control RAM 104. A panned and scrolled letter "A" 600 is shown in the upper left hand corner of the screen 601 of display monitor 116. The first table defines the image displayed on the horizontal scan lines between reference numeral 602 and 604. The second control data table is used to control the display of the image on the horizontal scan lines between reference numerals 604 and 606. The first control table uses the control data to perform any necessary pixel group boundary merging for the shifted letter "A" between columns 608 and 610. The remainder of the control data in the first control table, forces the output of the pixel multiplexer 102 to be all zeros between column 610 and the right hand edge of the screen. The zeros may be interpreted by the systems ramdac as "black" or any other preselected border color. Similarly, the entire control table data for the scan lines between reference numerals 604 and 606 merely forces the output of pixel multiplexer 102 to output zeros for every pixel group displayed in each horizontal line thereby forcing the vacated areas to a preselected border color.

Figure 7:
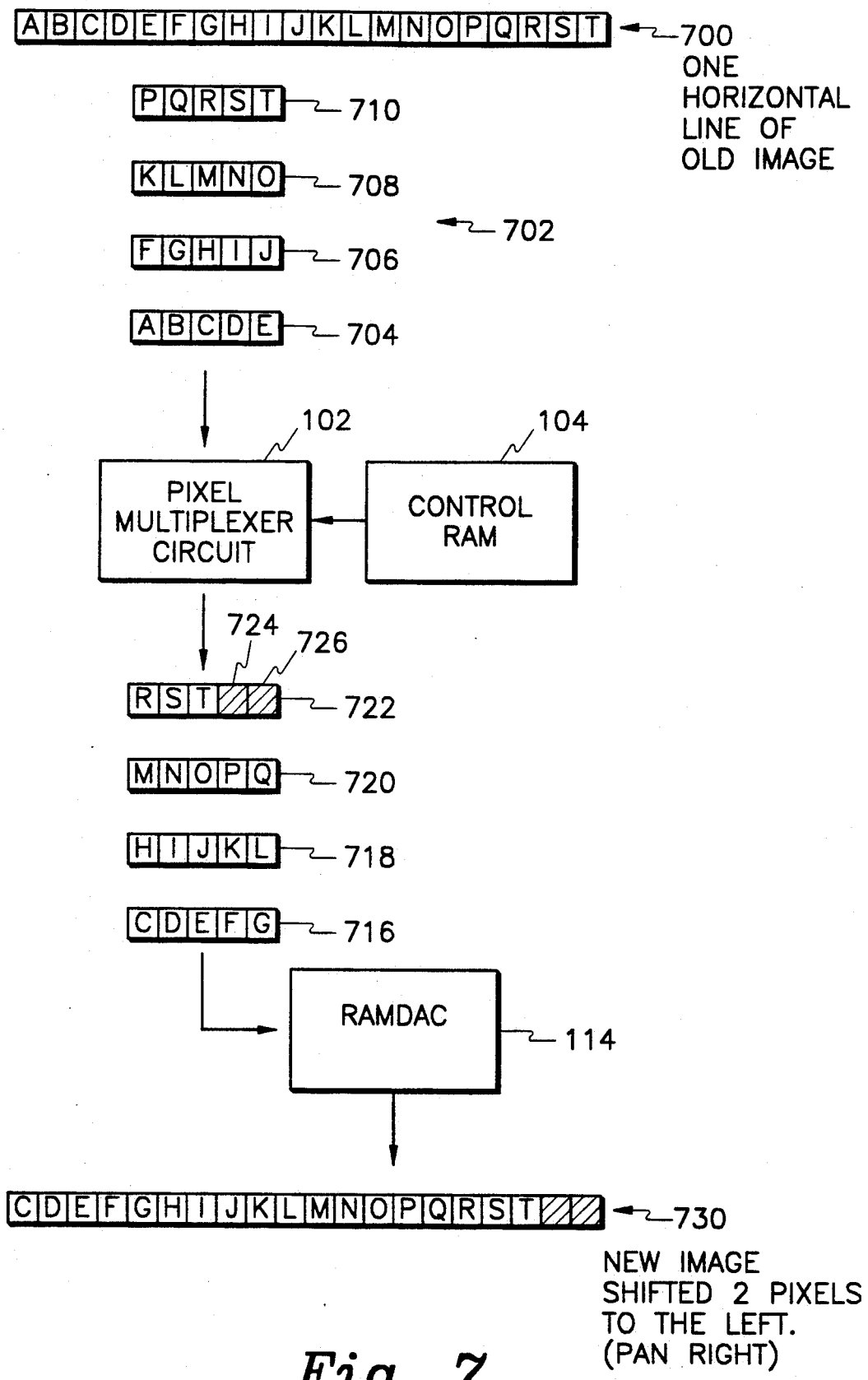
FIG. 7 is a diagram of the pixel group merge operation to accomplish a "pan right".

The panning system and method uses a combination of software and the inventive memory control video circuit to perform pan operations. FIG. 7 shows schematically how the present invention handles the pixel boundary portion of the pan operation. In order to accomplish a pan, a gross pan operation is first performed in software or microcode. This involves accessing image data at the closest pixel group boundary in the direction of the horizontal scan. For example, if an image is to be panned 4 pixel groups+2 pixels to the left, then the software merely sets the initial pixel group to be read from the framestore's video RAM serial shift registers at the fifth pixel group address over in each horizontal line. This is accomplished by asserting the column address strobe (CAS) during the video RAM transfer cycle for the displayed line and supplying the serial shift registers start address as the column address. In the preferred embodiment, the framestores might actually be initially accessed at a prior address to account for clock delays. This will be explained further in the DDA Algorithm section (section IV(6)) of this specification.

In FIG. 7, reference numeral 700 indicates how one line of an unpanned image might appear on a monitor. As has been explained, if this image were first to be shifted to the left by more than one pixel group length, a gross pan operation would first be performed in software. For example, if the image was to be shifted one pixel group plus a fraction, (e.g. less than 5 pixels), to the left (pan right), the microcode within the systems graphics processor would merely being to address pixel data starting with pixel group FGHIJ. The shift of a granularity of less than a pixel group would then be accomplished by pixel multiplexer 102.

A shift to the left by two pixel positions will now be explained by reference to FIG. 7. Reference numeral 700 represents one line of an image on the display monitor. As is illustrated by FIG. 7, the screen data is accessed from frame memory as a group of pixel groups 702. Each pixel group consists of data representing five pixels. First, on the first cycle of the gated group clock 302, pixels ABCDE are accessed in pixel group 704. Next pixels FGHIJ are accessed in pixel group 706. Next, pixels KLMNO are accessed in pixel group 708. Finally, pixels PQRST are accessed in pixel group 710. As each pixel group is accessed it is passed to pixel multiplexer 102. On the second and third cycles of the gated group clock 302, pixel groups 706 and 708 are loaded into the input registers (for example 210 and 214) of pixel multiplexer 102 and become the "previous" and "current" pixel groups respectively. On each subsequent cycle of the gated group clock 302, the old "previous" pixel group is discarded, the old "current" pixel group becomes the new "previous" pixel group and the next pixel group in line (e.g. 708) becomes the new "current" pixel group. Under control of control data from control RAM 104, pixel multiplexer 102 performs a "merge" operation on each "previous" and "current" pixel group. In this particular case, pixel multiplexer 102 merges the last 3 pixels defined in each "previous" pixel group, with the first two pixels defined in each "current" pixel group. As can be observed by reference to FIG. 7, first output pixel group 716, includes pixel data CDEFG. Second output pixel group 618, includes pixel data HIJKL. Third output pixel group 720 includes pixel data MNOPQ, while fourth output pixel group 722 contains pixel data RST. The last two pixel position 724 and 726 are forced to be a preselected border color, as will be explained shortly. It should be understood, that in a "wrap around" system, positions 724 and 726 of pixel group 722 would contain pixel data "A" and "B" respectively.

The step of "filling in" the vacated portions of the display monitor will now be explained. When the last piece of image data for the horizontal display line has been clocked out of the framestore, the control RAM 104 sends new control data to the 21:1 multiplexer section 206 via the control section 204. This control data instructs the 21:1 multiplexers to select the "low", (logical 0), line. This forces the multiplexers to output pixel groups of all zeros. These pixel groups make the monitor a preselected color, (typically black), in the "filled in" or "border" areas.

As can be observed by reference to FIG. 7, the output pixel group data is sent to the ramdac 114 and is eventually displayed on the display monitor 116 as CDEFGHIJKLMNOPQRST[black][black].

In order to move an image to the right (pan left), the process is reversed. The "filled in" data merged with the first accessed pixel group and then the remaining merged data is displayed.

It should be understood that the merge function may be used independently from the "fill in" function. For example, the "merge" function can be used to move a window on a screen from one portion of the screen to another. This is explained in more detail in the "Hardware Windows" section of this specification.

It should also be understood that the standard wrap around method may be appropriate for some applications and that a pan operation may be performed without the "fill in" function in these cases.

As has previously been stated, the control RAM 104, is loaded with control data by the graphics controller during vertical blank (i.e. before the new frame is drawn on the monitor). The programer or program is aware of how far over an image is to be shifted and has time to load the proper control information into control RAM 104 before the draw operation begins. A more detailed description of the control RAM load operation is provided in the "State Machine Circuit" section of this specification.

It is important to note that a simple pan function may be performed without the use or aid of the control RAM 104 or any other state machine. By merely loading control data into the secondary control registers, 244, 252, 260, 268 and 276 from any source, pixel multiplexer 102 can be made to perform a pan of any static value. For example. if the entire screen, (being refreshed from framestoreO 110 for example), were to be shifted to the left by two pixel positions, a control word consisting of binary 11000100001100100010000 01001 could be loaded into the secondary control registers and kept static for the entire refresh cycle of the display monitor. This would cause the last three pixels from each "previous" pixel group to be merged with the first two pixels from each "current" pixel group.

Advantageously, the present invention can pan any stored image by one pixel position on the monitor at a time. This is a significant advantage over many systems where the "zoomed" image can only be panned by one image pixel position at a time (i.e. a 2:1 magnified image can only be panned by 2 displayed pixels at a time). This monitor pixel position panning of a zoomed image is possible because the State Machine Controlled Zoom operation, described below, may function along with the Pan invention. Neither invention corrupts or modifies the stored image data.

(4) Hardware Windows

Advantageously, by accessing data from two framestores (110 and 112) and giving the graphics processor 108 the ability to access a different control table for each horizontal display line, hardware window effects may be created.

Figure 8:
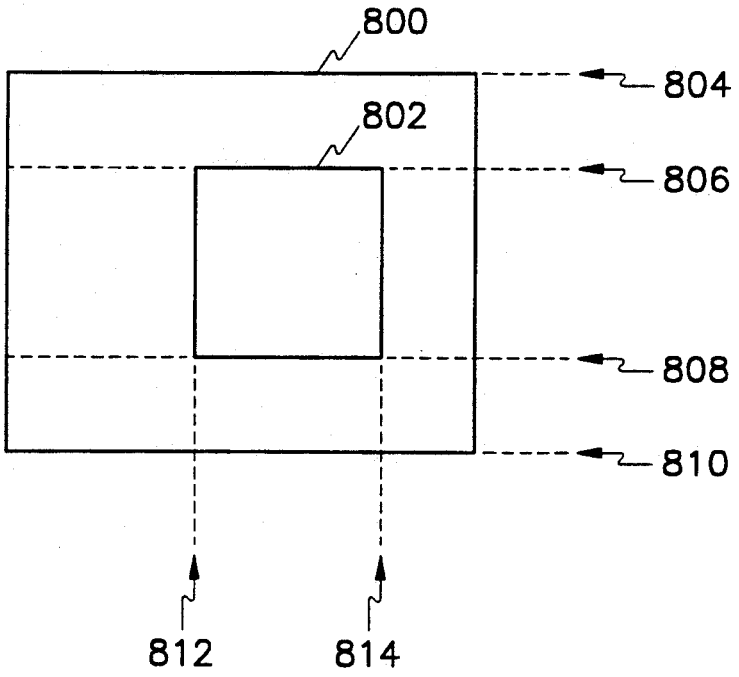
FIG. 8 is a diagram of a hardware created window.

The concepts necessary to hardware windowing are better understood by reference to FIG. 8. FIG. 8 shows the display screen 800 of the display monitor 116. A window 802 is shown within display screen 800. In one embodiment the window 802 is made up of image data from one framestore, while the image outside of the window is made up of data from a second framestore. As has been explained, for every pixel group displayed on the screen the pixel multiplexer 102 may select any of the "current", or "previous", pixel groups accessed from either framestore0 110 or framestore1 112. The actual mechanics of the hardware window operation may be better understood by reference to FIG. 8 and table 1-1 (within).

The display screen of FIG. 8 is generated using two separate tables of control data within the control RAM 104. This may be better understood by way of an example. Suppose that the image data within the window 802 is supplied by framestore1. Also assume that the remaining image data is supplied by framestore0. The horizontal scan area appearing between reference nos. 804 and 806 would be developed by the pixel multiplexer 102 using the default table (table 1) in control RAM 104. In other words, the horizontal scan area between reference nos. 804 and 806 is made up of the unpanned, unzoomed, and unmanipulated pixel data being inputed from framestore0. Similarly, the horizontal scan area between reference nos. 808 and 810 is also developed using the "default" control data table from control RAM 104.

The exact contents of the "default" control table may be better understood by reference to table 1-1 within. From table 1-1 it may be seen that each of the 256 control words within control RAM 104 will be defined so as to select the current pixel group of framestore0 and so as to have each pixel in each input pixel group output in unmanipulated form (in the same position as it was input). In order to accomplish this each word in the control table is set to binary 11010000100101010010110 1100.

The control of the window section of the horizontal scan will now be explained. As can be seen by reference to FIG. 8 the window 802 appears between horizontal scan lines 806 and 808. Further, the data within the window (from framestore1) appears between vertical locations 812 and 814. Assume that the window starts at the 100th pixel group and ends at the 150th pixel group. In this case the first 99 words in the control table would appear just as above. The 100th through the 150th word would be set up so as to select the current pixel group from framestore1 in unzoomed, unpanned form. Each of these words would be a binary 11110001100111010110111 1100. The 151st through 256th control word in the control table would be programmed just as the first 100 words.

If it were desired to place the window 802 within the boundaries of pixel group (for example starting at the third pixel end of pixel group 100 and ending at the second pixel end of pixel group 150), then the 100th and 150th table locations would be programed so as to perform a merge. Table location 100 would be programmed so as to display the first two pixel positions from framestore0 and the last three pixel positions in the 100th pixel group from framestore1. Similarly the 150th entry in the control table would be programmed so as to display the first two pixel locations from framestore1 and the last three pixel locations from framestore0.

Many variations of the hardware window invention are possible. For example, were the control RAM 104 to have enough locations so as to contain one table for every line displayed, then windows could be opened and manipulated having any shape. In other words you could have a circular window, an elliptical window, or even windows shaped as irregular polygons. It should be further understood, that although control RAM 104 is utilized as the preferred embodiment of a state machine, any state machine may be used in its place. For example, a vector processing circuit may be used in place of control RAM 104 so as to develop control data tables for irregularly shaped windows.

Advantageously, the system can not only open up and manipulate windows of any shape, but it can do this to the granularity of one pixel (i.e., within pixel group boundaries) and at video rate.

(5) State Machine Controlled Zoom

As has been stated, pixel group access systems often encounter problems performing zoom operations at video rate. If one wishes to perform a zoom operation in the horizontal direction, each pixel must be repeatedly displayed a number of times equal to the desired magnification factor. Unfortunately, in machines that access pixel data in groups (pixel groups), merely repeating the accessed data on the screen results in a distorted and meaningless image. For example, assume an image is made up of 10 pixels—A,B,C,D,E,F,G,H,I and J. The first line of a 2:1 magnified image should appear as A,A,B,B,C,C,D,D,E,E,F,F,G,G,H,H,I,I,J,J. In a system which accesses data representing five pixels at a time, the first pixel group accessed from memory will contain the information for pixels A,B,C,D and E. If the accessed data is simply duplicated, for example by holding the data as the systems video DAC for two clock cycles, the image on the monitor will appear as A,B,C,-D,E,A,B,C,D,E. Similarly, data acquired on the second pixel group access would appear as F,G,H,I,J,F,G,-

H,I,J. It should be easily observed that this is not the desired result.

The graphics processor 108 solves the problem of video rate zooming by programing control RAM 104 to hold each pixel group of pixel data at the input of pixel multiplexer 102 for a number of gated group clock cycles determined from the horizontal magnification factor, and to duplicate at least some of the pixel positions within each pixel group to achieve the desired magnification factor. A "merge" operation is performed to "push over", into the next pixel group, any pixel data that is displaced in the duplication process. In addition, by using a software address table, the graphics processor repeatedly accesses the horizontal line data from the appropriate framestore a number of times equal to vertical magnification factor thereby causing that line to be reprocessed by the pixel multiplexer. The pixel multiplexer performs the magnification functioning the direction of the horizontal scan line, while the graphics processor program or microcode performs the vertical magnification function through the calculated/repeated presentation of processed horizontal line data to the display monitor.

Figure 10:
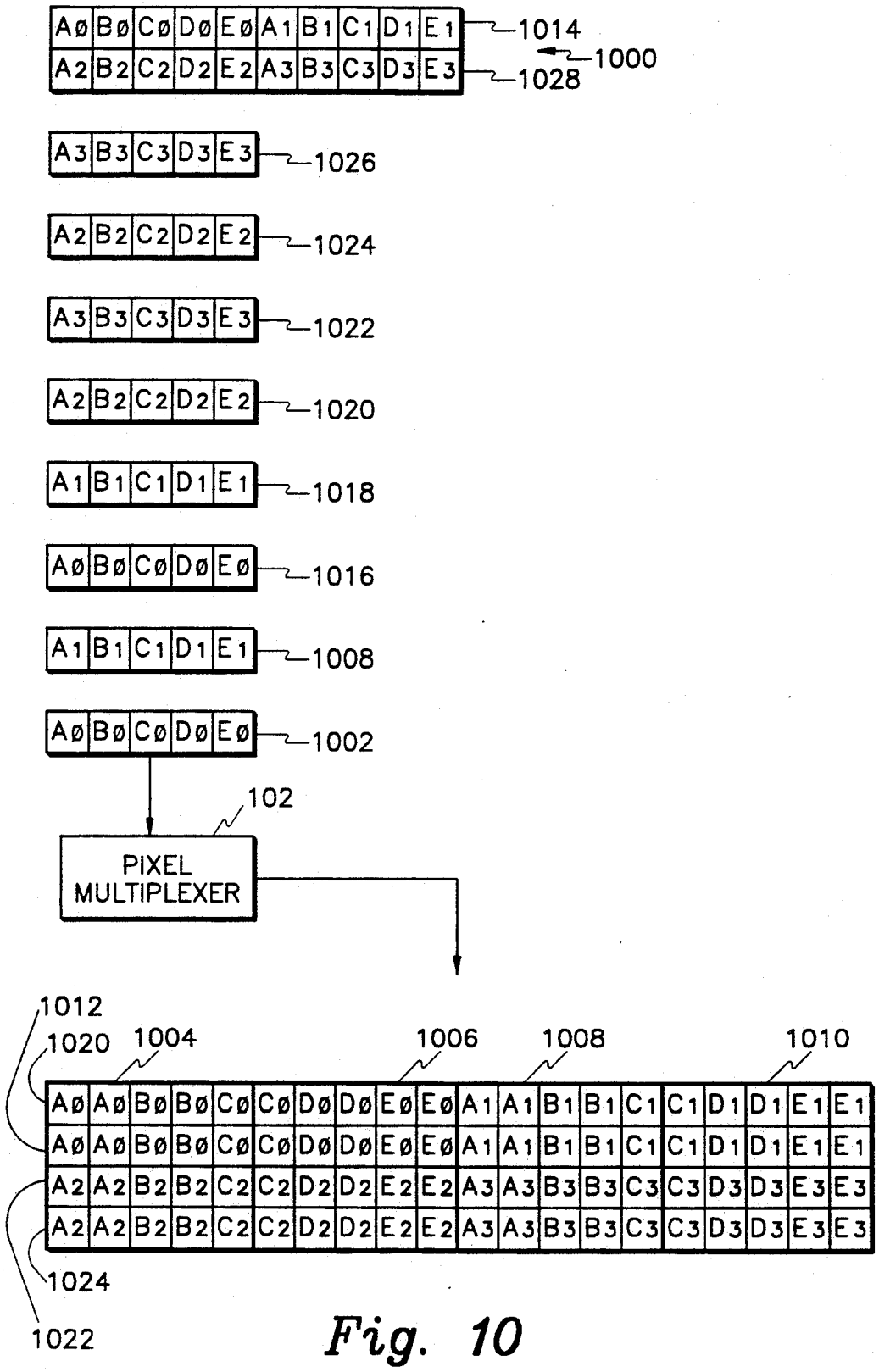
FIG. 10 is a diagram of the operation used to accomplish a 2:1 zoom on a single pixel group.

The zoom operation is better understood by reference to FIGS. 1, 2 and 10. Assume a 2 pixel group by 2 pixel group window of pixel data 1000 from framestore0 110 is displayed on monitor 116. Further, assume that the displayed window is to be magnified by a factor of two.

In operation, the graphics processor will first cause the pixel multiplexer to be initialized during the horizontal blank period. The initialization will vary somewhat depending on whether the first pixel group in the horizontal display line is to be "zoomed". Initialization is covered in more detail in section IV(6).

In order to perform a zoom by a factor of two, each input pixel group must be held at the input of the pixel multiplexer 102 for two gated group clock cycles. This is accomplished by alternately enableing and disableing the framestore0 video data clock through the use of bit 27 in each control word (see table 1-1). It should be understood that the clock enable data within the control words leads the control data by two clock cycles. This is also explained in more detail in section IV(6).

On the first gated group clock cycle after the end of the horizontal blank period, the first input pixel group 1002 is processed by the pixel multiplexer 102. The first two input pixels, A0 and B0, are duplicated for display in the first ouput pixel group. The third input pixel C0 is used to "fill up" the first output pixel group 1004. The first ouput pixel group 1004 appears as A0,A0,B0,B0,C0 on the display monitor. As may also be observed, input pixel C0 has not been duplicated.

Due to the fact that the control RAM 104 has disabled the video data clock of framestore0, the same first input pixel group 1002 is loaded in to the pixel multiplexer 102 for processing a second time. On the next gated group clock cycle the first input pixel group 1002 is processed so as to put pixel C0 into the first position of the second output pixel group. The remaining pixels, (D0,E0), in the first input pixel group 1002 are duplicated and placed into the remaining positions of the second output pixel group 1006. The second ouput pixel group 1006 appears as C0,D0,D0,E0,E0

The second input pixel group 1008 is processed in a similar manner. The framestore0 video data clock is reenabled, through the use of bit 27 of the third control word, so that the second input pixel group 1008 is loaded into the pixel multiplexer 102. The pixel data is processed just as explained above to form the third output pixel group 1008 which appears as A1-,A1,B1,B1,C1.

While the loading of the second input pixel group occurs, control RAM 104 disables the framestore0 video data clock once again. This causes the same second input pixel group 1008 to again be loaded into the pixel multiplexer 102 for processing on the subsequent gated group clock cycle. Just as explained above, the second input pixel group is processed a second time so as to ouput the fourth output pixel group 1010 which appears as C1,D1,D1,E1,E1.

That ends the window magnification process for the first horizontal scan line. The remainder of the scan line may be filled, for example, with pixel groups from framestore1 in straight, nonpanned, nonzoomed form.

The second display line 1012 of the magnified window is formed by having the graphics processor 108 reaccess the same input pixel groups used on the original first window display line 1014. As can be seen from FIG. 10, The first two input pixel groups 1016, 1018, which are used to form the second output display line 1012, are identical to the first two pixel groups, (1002, 1008 respectively), which were used to form the first output display line 1020. These pixel groups are processed in a manner identical to those used for the first output display line 1020.

From the above discussion it may be seen that the same principles apply to the third 1022 and fourth 1024 output display lines which are processed using input pixel groups, (1020, 1022, 1024, 1026), used in the second original display line 1028. An example of the control data which could be used to display the first four display lines is shown in appendix A.

Advantageously, the zoom factor does not have to be an integer number, by using DDA techniques, (which will be explained later), any magnification factor of 1 or more can be chosen. For example 1.25, 1.7 or a whole number plus any fraction. This represents a significant improvement over many prior systems. In older systems, where the clock is merely stopped to duplicate pixels, it is difficult or impossible to shut off the frame memory clock for a varying number of cycles in a single horizontal scan line. The present invention completely overcomes the fractional magnification problem as will be explained in section 6. Further, DDA methods allow the image to be centrally zoomed (as opposed to merely zoomed off to the right of the screen from the viewer perspective).

(6) DDA Algorithm for Generating Control Tables i. Review of the General Principles

This section is concerned with the generation of the control tables used to accomplish such effects as panning, zooming, windows, etc. As has been explained, the pixel multiplexer 102 manipulates and merges pixel data under control of "control data" stored in the control RAM 104. This data is organized into tables. Each table contains the control data necessary to process and display one complete horizontal line of image data on the display monitor. Details of the pixel multiplexer hardware and control RAM are given in other sections; this section is only concerned with how the tables are built.

To make the operation clearer the following definitions will be used. The pixel data for an entire horizontal display line is a "strip". A group of pixel data accessed in one framestore access cycle is a "pixel group". A "strip" typically consists of a number of "pixel groups". A "strip" of "pixel groups" appearing at the input of the pixel multiplexer 102 is referred to as a "input strip". A "strip" of "pixel groups" displayed on the monitor screen is referred to as an "out-put strip". The complete image viewed on the display monitor is built of a number of output "strips". As has been explained in other sections, the graphics processor 108, (or any other cpu being used for this purpose), many select the image data to be used for any input strip from any location within any one of two framestores 110, 112. It should also be understood that the graphics processor, (or other CPU), will be able to access some type of memory in which it can store, and from which it can recover data. This memory is to be distinguished from control RAM 104.

In order to display a complete image on monitor 116, a number of output strips must be used (i.e. one for each horizontal line on the screen). In order to draw the complete image, the graphics processor must know, which input strips to use, and how far over to the left the image will eventually be shifted (if at all). Further, the graphics processor must know which control table within control RAM 104 must be used to process each input strip. There are thus four tables of information which are generated in order to display a complete image on the display monitor. These are:

| | | |
|---|---|---|
| (1) | y-transfer address list. | which input strip to select for each output strip. |
| (2) | SSA list | the input position that will end up on the left of the output |
| (3) | Table table | which x control table to use for each horizontal output strip. |
| (4) | x-transfer table | this is another name for each control table stored in the control RAM 104. It determines which input pixel goes where. |

The pixel multiplexer 102 makes it possible to achieve a wide variety of effects—the current focus will be on the basics such as zooming, panning, and windows.

Although the x-transfer table and y-address list are not exactly the same, both use the same technique for zooming/panning. A variation on a ramp generating DDA (Digital Differential Analysis) is used. This is explained in more detail in subsection ii.

The table table holds the pointers to which x-transfer table to use for each strip. For example, x-transfer table one might hold a table of "copy straight through" control data, while x-transfer table two might contain control data to accomplish a zoom with a factor of two. By setting the y-transfer addresses correctly, a picture can be displayed with a copy of part of it zoomed by setting the top half of the table table set to x-transfer table one and the bottom half to x-transfer table two. This concept of using two different x-transfer tables has been explained to some extent in the "hardware windows" section of this specification as it relates to windowing.

The generation of the x transfer (control) and y transfer address tables will now be described in detail. The algorithms are described for a screen 1280 pixels wide, consisting of 256, five bit pixel groups, although the same techniques can be used for other configurations.

Each pixel group has a control word, in control RAM 104, that determines what is output. These fields have been previously described by reference to table 1-1. By way of review, these fields control the following:

Whether or not to the framestore clocks will be enabled (advanced),

Which framestore is to be used for input for each position in the output pixel group, Whether the "current", or "previous" pixel group will be used from the above-selected framestore, and Pixel routing.

In order to generate the x-transfer (control) and y transfer address tables the a DDA algorithm is used. In addition, a second algorithm (the control table calculation algorithm) is utilized to generate the x-transfer (control) tables. These programs are used in both window and non-window situations.

ii. Non-Window DDA calculated table

The following parameters are used as inputs to the DDA algorithm for non-windowed images:

bottom left xy coordinate top right xy coordinate displayed framestore

The input parameters define the rectangular region of the image memory to be displayed to occupy the entire monitor screen.

In order to draw the entire display screen, the invention performs a DDA (explained below) in both the X and Y directions. The DDA is accomplished by way of a software program. The Y DDA output is used directly in the y-transfer address list. The X DDA output is used as the basis for calculating the contents of the x-transfer tables (i.e. the control tables within control RAM 104).

ii(a). The DDA Algorithm

In general, a DDA (Digital Differential Analyzer) is used to interpolate a variable between two values over a range which is equal to or exceeds the difference in values. For example, if the variable n were to be interpolated from the value 1 to the value 3 in 11 steps the 12 output values would be 1 1 1 2 2 2 2 2 2 3 3 3

Because the range is greater than the change in value, the DDA can be regarded as a means for determining for each output value whether the value should be incremented from the previous value or not. The pattern of increments should result in the smoothest possible transition between the two values.

The standard DDA algorithm can be described as follows:

```
Definitions
v1 - initial value
v - incrementing value for output
delta - change in value
steps - number of steps
error - error term used to control incrementing
output - output array
begin
    error = steps/2;
    v = v1;
    i = 0;
    for (number of steps +1)
```

-continued

```
        output[i] = v;
        increment i;
        if (error ≦ 0)
            increment v;
            error = error + steps;
        endif
        error = error − delta;
    endfor
end
```

As applied to the present invention, "steps" is equal to the width (height) of the monitor 116 and delta is equal to the width (height) of the displayed region of the image memory. The results of the DDA are stored in an array, (which will be referred to as the "Pixel Map Array") which holds the framestore pixel address to be displayed at each output pixel on the monitor. It is important to note that it is the "pixel" address and not the "pixel group" address that is stored in this array. The importance of this distinction will become apparent shortly.

The inventors have discovered that the best visual effect is obtained if the DDA is slightly modified so that every pixel displayed is as near as possible of equal displayed width. In other words the "half pixels" at each end of the output are eliminated to produce an output such as 1 1 1 1 2 2 2 2 3 3 3 3

To produce the above effect, the DDA should be modified as below:

```
begin
    error = steps;                  (not steps/2)
    v = v1;
    i = 0;
    for (number of steps + 1)
        error = error − delta   (calculate error before error test)
        output[i] = v;
        increment i;
        if (error ≦ 0)
            increment v;
            error = error + steps;
        endif
    endfor
end
```

ii(c). Table Value Calculations

The control table calculation algorithm uses the Pixel Map Array calculated by the DDA as an input. As has been explained, each element of the Pixel Map Array holds the x address of the image memory pixel to be displayed at that screen position. In the case of the present embodiment, the display screen width is 1280 pixel positions on each horizontal scan line. The Pixel Map Array would therefore be 1280 locations wide.

From the Pixel Map Array, the table value calculation algorithm calculates four output arrays:

1. The Shift Array—a screen width array holding the shift multiplexer (A–E) value for each output pixel. This values correspond to bits 21–23, 16–18, 11–13, 6–8, and 1–3 of the control words. The format of the control words is shown in table 1-1 (found in section IV(2) of this specification).
2. The Select Array—a screen width array holding a flag for each pixel to select the current or previous pixel group input register. This flag corresponds to bits 24, 19, 14, 9 and 4 of the control words.
3. The Frame Array—a screen width array holding a flag for each pixel, selecting the frame store from which that pixel is to be displayed. This flag corresponds to bits 25, 20, 15, 10 and 5 of the control words.

and, for the framestore selected for the non-windowed screen either:

4(a). The Framestore0 Clock Array—a screen width-/pixel group width array holding a flag for each pixel group to control whether or not the framestore0 is clock enabled by this output pixel group. This flag corresponds to bit 27 of the control words.

Or,

4(b). The Framestore1 Clock Array—a screen width-/pixel group width array holding a flag for each pixel group to control whether or not the framestore0 is clock enabled by this output pixel group. This flag corresponds to bit 26 of the control words.

Each element of the Shift Array is calculated as: the corresponding input pixel × (horizontal) address MODULO the pixel group width. In the present embodiment the pixel group width is 5 and the x address is anywhere from 0 to 1279 (1280 locations).

Each entry of the Clock Array, (for framestore0 and framestore1), is calculated by inspecting the input pixels used in the current and previous output pixel groups. If a new input pixel "A" is used for the first time anywhere in the current output pixel group then the framestore is clock enabled.

So: output groups . . . CDE ABCDE or . . . DD EEAAB would cause the framestores to be clock enabled; output groups . . . AA BBCCD or . . . EAA ABBBC would not.

The first output pixel group cannot refer to a previous group. This group always clock enables the framestore, to ensure that at least one valid output group is always read from the video ram.

The Select Array is related to the clock array: any pixel in the output pixel group BEFORE a new pixel "A" being used for the first time uses the previous group. All other pixels use the current group. If the output group uses no new "A" pixels, all the pixels use the current group.

All locations of the Frame Array are set to select the frame store input as a parameter.

The contents of these arrays can then be merged to form complete control words.

ii(d). The Serial Start Address Table

As has been explained, the display screen may be thought of as being made up of a group of horizontal display lines being draw from the top of the screen on down to the bottom. The graphics processor, (or other processing device), makes use of a Serial Start Address table (SSA) to determine from what location in the framestores the leftmost border of the display will come from. For example, in order to do a gross pan right, (more than one pixel group), an image must be shifted to the left. In order to accomplish this, the image data within the framestore would be addressed starting at some amount of pixel groups in from the original image. All locations of the serial start address table hold the same value: the leftmost address of the displayed region of the image memory divided by the pixel group width. Any fractional components of the division are merely striped off (i.e. the result is rounded down to the nearest whole integer).

ii(e). Accounting For Pipeline Stages (clock delays)

The data path between the video ram serial outputs and the inputs to the select multiplexers contains pipeline stages. These include the serial output register of the video ram and the current group register of the video ram and the current group register, but not the previous group register because this can be regarded as a temporary copy of the previous value contained in the current group register. A number of constraints must be met affecting the calculation of the control ram contents to take these pipeline delays into account.

In a system with N pipeline stages the clock enable control field in the control word needs to be shifted by N locations to the left in relation to all the other fields in the control word of the state machine. The method by which these shifted fields are correctly accessed is explained below.

All the stages of the pipeline must be correctly initialized before output groups can be calculated: consider the case of a display in which the first output group uses only the current input register (210 or 214), for example a non-zoomed, non-panned display. If there are a total of N pipeline stages, then N gated group clock pulses must be applied to the pipeline to initialize all stages before the display line is started. However, for certain zoomed and panned displays, the first output group requires both current and previous group registers to be initialized. To achieve this, N+1 gated group clock pulses must be applied to the pipeline before the end of the horizontal blank.

A similar situation occurs when the first pixel group in a line is to be zoomed. Due to the fact that the present clocking scheme always causes the framestores to be enabled for the first two gated group clock cycles, input pixel groups from two different addresses are always initially loaded into the input and holding registers. This forces any magnification of the first pixel group in the displayed line to be performed using the "current" pixel group, (stored in the selected input register 210 or 214).

The above cases can be satisfied by constructing the video timing generator to always output N+1 gated group clock pulses before the end of the horizontal blank. But, for a display which doesn't use the previous group register in the first output group, the video ram serial start address is decremented by one so that the first required input group will be clocked in the current group register after N+1 clock pulses.

So, a gated group clock is enabled for the active display line, plus N+1 cycles. The clock to the two bit register 130, on the output of the state machine ram, is a free running group clock that is permanently enabled. This is necessary to ensure the framestores are properly clock enabled in time for the first gated group clock. The ramdac is also clocked from the free running group clock to ensure that the syncs are properly produced during the blanking periods.

From the above discussion it may be seen that the state machine, (in the preferred embodiment, control RAM 104), will receive a gated group clock cycle for each group on the displayed line plus N+1. N of these extra clocks also offset the clock enable bits by N clocks and enables and multiplexer select control fields in the control ram to be accessed correctly. To avoid the need for a control table with an entry for each displayed group plus N, the select control fields for the last N groups can be stored wrapped around into the first locations of the table. During the displayed line, the counter will receive N+1 extra gated group clock cycles, the counter will physically wraparound and access the first N+1 locations of the ram for the second time at the end of the line, correctly accessing the wrapped around multiplexer select control fields. This causes no problems because: for the first N group control words the select multiplexer controls accessed from the control RAM 104 are actually for the end of the line but are unused, and for the last N group control words of the line, the framestore clock enable outputs are actually for the beginning of the line but are irrelevant.

In the present embodiment there are a total of 2 pipeline stages to consider. These are the Video RAM serial shift registers, and the input registers (210 or 214) which contain the "current" pixel group. As related to the above discussion, N would be equal to 2, and N+1 would be equal to 3. On the first gated group clock cycle a first pixel group of data would be clocked from the framestores to the data inputs 220, 224 of the input registers 210, 214. On the second gated group clock cycle, the pixel groups at the input register data inputs 220 and 224 would be loaded into the input registers 210, 214 while a second pixel group would be clocked from the framestores to input register data inputs 220, 224. On the third gated group clock cycle, the data from the input registers 210 and 214 would be shifted into the respective "previous" data registers 212, 216. On the same, (third), gated group clock cycle the data at the input register data inputs 220, 224 would be loaded into the input registers 210, 214. The two input registers 210 and 214 may also be referred to as the "current" input registers. Further, on the third gated group clock cycle a new pixel group is clocked from the framestores to input register data inputs 220, and 224. At the end of the third gated group clock cycle the system will be initialized. Starting on the fourth gated group clock cycle, the proper input pixel groups are loaded into the input ("current") registers 210/214.

Figure 13:
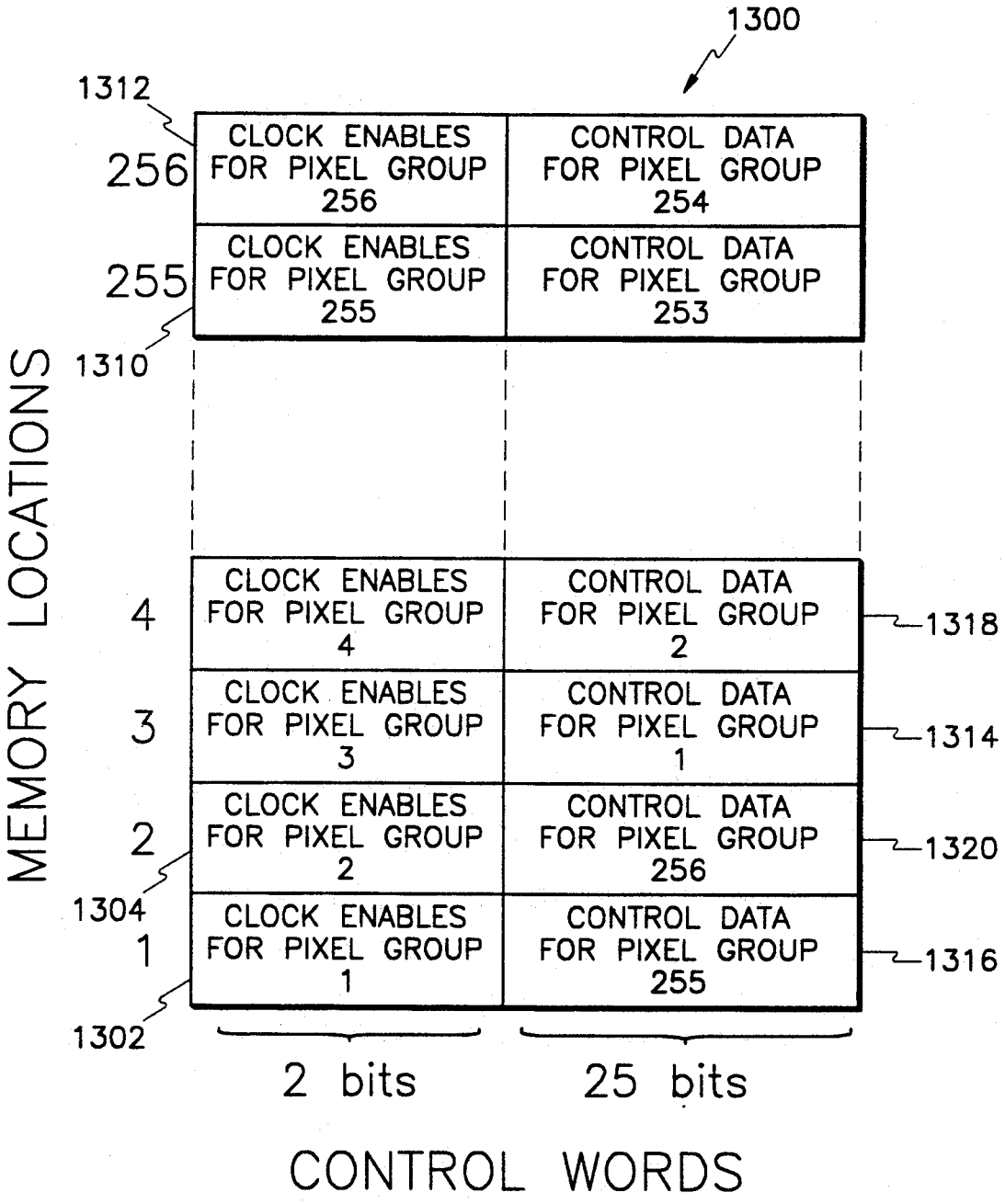
FIG. 13 is a cut-away map of a control table.

The role of the control RAM 104 in these sequence can be seen from FIG. 13. Prior to the first gated group clock cycle, the first two bits of control data 1302 are loaded into the two bit register 130, by the free running group clock 304. On the first gated group clock cycle, the clock enable bits 1302 (bits 27, 26) for the first input pixel group are used by the modified AND gates 126, 128 to enable or disable to the framestore video data clocks (at lines 156 and 158). The control data 1316 is unused during this cycle. On the second gated group clock cycle, the same clock enable bits 1302 will appear again due to the effect of the two bit register 130. This will cause second input pixel group to be be clocked from the framestores. The control data 1320 is also unused during this second cycle. On the third gated group clock cycle, the clock enable data 1304 for the third input pixel group is used by the framestores. Also on the third gated group clock cycle, the control data 1314 for the first input pixel group is clocked from the control ram 114 and appears at the inputs to the primary control registers 242, 250, 258, 266 and 274. At the end of the third gated group clock cycle the system is primed and the pixel multiplexer is ready for the end of the horizontal blank period. If one could take a snap shot of the pixel multiplexer at the end of the third clock cycle it would be seen that:

The first input pixel group is in the "previous" registers 212/214.

The second input pixel group is in the "current" registers 210/214.

Bits 1 through 25 of the control data for the first output pixel group are at the inputs 248, 256, 264, 272 and 280, of the control registers.

It should be understood that the first three gated group clock cycles occur during the horizontal and vertical blank periods.

It may be seen from the above discussion that the first two locations of control RAM 104 must contain control words which inlcude the clock enables (bits 27 and 26) for second two words of control data. The remaining 25 bits of the first two control words contain control data for the last two pixel groups that will be output to the display monitor. In other words the clock enable bits (27 and 26), lead the control data by two gated group clock cycles.

The relationship between the clock enable bits and the remaining control data can be better seen by reference to FIG. 13. FIG. 13 shows a map of a typical control table as it might appear in the control RAM 104. The map is generally referred to by reference numeral 1300. The first memory location in the control table contains the clock enable bits 1302, (bits 27 and 26, table 1-1), that correspond to the first output pixel group 1314, (the control data for which 1314 is stored in memory location three). The control data 1316 in the first memory location is actually for the 255th pixel group (i.e. the last pixel group in the displayed line). Similarly, the second memory location in the control table contains the clock enable bits 1304 for the the fourth ouput pixel group, (the control data for which 1318 is stored in memory location 4), while it contains the control data 1320 for the last pixel group (group 256).

FIG. 13 also illustrates the concept of "wrapping around" the eight bit counter 122. From FIG. 13 it may be seen that the first two words of control data are for the last two pixel groups. The clock enable data for these two words 1310 and 1312 is at locations 255 and 256 respectively.

ii(f). Window DDA Calculated Tables

As has been explained in section IV(4), hardware windows are formed using to separate framestores and at least two control tables. One framestore contains the window data. The second framestore contains the background data. Also, one control table is used for the windowed lines of the display monitor, while the second control table is used for the areas that contain only background pixel data. In order to form the control tables for a display screen having at least one window the following input parameters are used:

bottom left xy coordinate of background image
top right xy coordinate of background image
bottom left xy coordinate of window image
top right xy coordinate of window image
bottom left xy coordinate of window on screen
top right xy coordinate of window on screen
background framestore The input parameters define the rectangular region of the image memory to be displayed, to occupy the monitor screen as a background, the size of a rectangular window on the monitor and the image used to occupy the window.

The X and Y DDAs are calculated using the background image size exactly as the non-window case, producing complete X and Y output pixel arrays. These output arrays are used to produce the table contents for the portions of the screen above and below the window.

Window DDAs are then executed, just for the range of the window on the monitor. The outputs from the window DDAs overwrite the pixel positions in the background DDA output array that are now occupied by the window. All output pixels overwritten are flagged as being sourced from the opposite framestore.

The arrays used to form control words can now be calculated. The Frame Array is set to select the window frame in all locations where the DDA overwrote the background DDA. The Shift Array is calculated exactly as per the non-window case, regardless of the frame of origin of each pixel. Two Clock Arrays are now needed, one for each framestore. The background framestore clock array is identical to the background array calculated for the portions of the screen above and below the window. The window framestore clock array must clock enable the framestore in the first location, disable the framestore during all locations up to and including the location controlling the group in which the leftmost edge of the window appears, and then follow the standard algorithm for all group locations until the window terminates.

The select array is initialized with the values calculated for the background array, and then updated for all pixel positions within the window using the standard algorithm. In the first (possibly incomplete) window pixel group only the pixels in the window are used in the algorithm, only window pixels appearing before a pixel "A" from the window frame are set to select the previous group register (i.e. holding registers 212 or 216 depending on whether framestore0 or framestore1 is used).

There are also two SSA lists, the background frame SSA list is set to a constant value: the leftmost image memory address of the displayed background image divided by the group width (the result being rounded to the lower integer). The window frame SSA list is also set to a constant value: the leftmost framestore address of the displayed window divided by the pixel group width just as above.

(7) The Role of the Video Timing Generator

The video timing generator 106 creates the pixel clock 300 (109 MHz) on line 132. From this clock it generates the horizontal and vertical syncs (on lines 160 and 162 respectively) and the blanking pulse (line 164) for the ramdac 114 on the video output. These three signals are then used to form an interrupt to the graphics processor 108 at the start of each horizontal blank, or at the horizontal sync pulse during vertical blanking. A status bit is also sent back to the graphics processor 108 indicating the start of the vertical blanking pulse.

The pixel clock 300 is divided by the pixel group size (preferably 5) to form the free running group clock 304 and gated to form the gated group clock 302. The free running group clock 304 is sent to the two bit register 130 and the ramdac 114. The gated group clock 302 runs during the active display line PLUS 3 cycles before the beginning of the line. During normal operation the gated group clock 302 is running during the active display area of each scan line. The gated group clock 302 can be disabled to allow the graphics processor to form an explicit clock, this being used to clock the 8-bit counter 104 while loading the control RAM 104.

(8) The Role of the Graphics Processor

For a good implementation of the invention the graphics processor must be capable of a number of functions. The preferred graphics processor will be capable of executing an interrupt routine at the end of each line and performing all the necessary operations before the next line. Alternatively for a slower graphics processor, another hardware state machine could be used to perform these functions.

It must be able to select which line from the frame store is to be displayed on each line of the screen (to produce a zoomed image in the Y direction). In one implementation, the graphics processor simply reads the next address for each screen line from a list stored in ram. This list can be calculated either by the graphics processor or a further processor.

The processor must select the state machine table to be used for each line of the screen. For example, from FIG. 8 it may be seen that in the hardware window operation, a block of lines in the middle of the screen uses a different table than the rest of the screen. Again, in the preferred implementation the graphics processor may simply uses a list from a ram, holding the table to be used for each line.

The processor must be able to pan the screen to the nearest pixel group. This is so that the multiplexers receive the pixel group data at the beginning of the image line. The graphics processor may be designed to use the pan capability built into the video rams, where the tap point of the video ram shift register can be set to any pixel group. Again the tap point is read from a ram list for each line.

Finally, to change the screen configuration instantly from one configuration to another without any visible artifacts, all the tables used by the state machine and the graphics processor must be capable of being changed, together, during one vertical blanking time. This normally involves the use of double buffering, so that the table values can be calculated at 'leisure' in a buffer area. Once all the tables are complete the processor and state machine switch to using them. The switching can be achieved by allowing the buffer area to be used directly, or by copying all the tables from the buffer area during the vertical blank.

Figure 9:
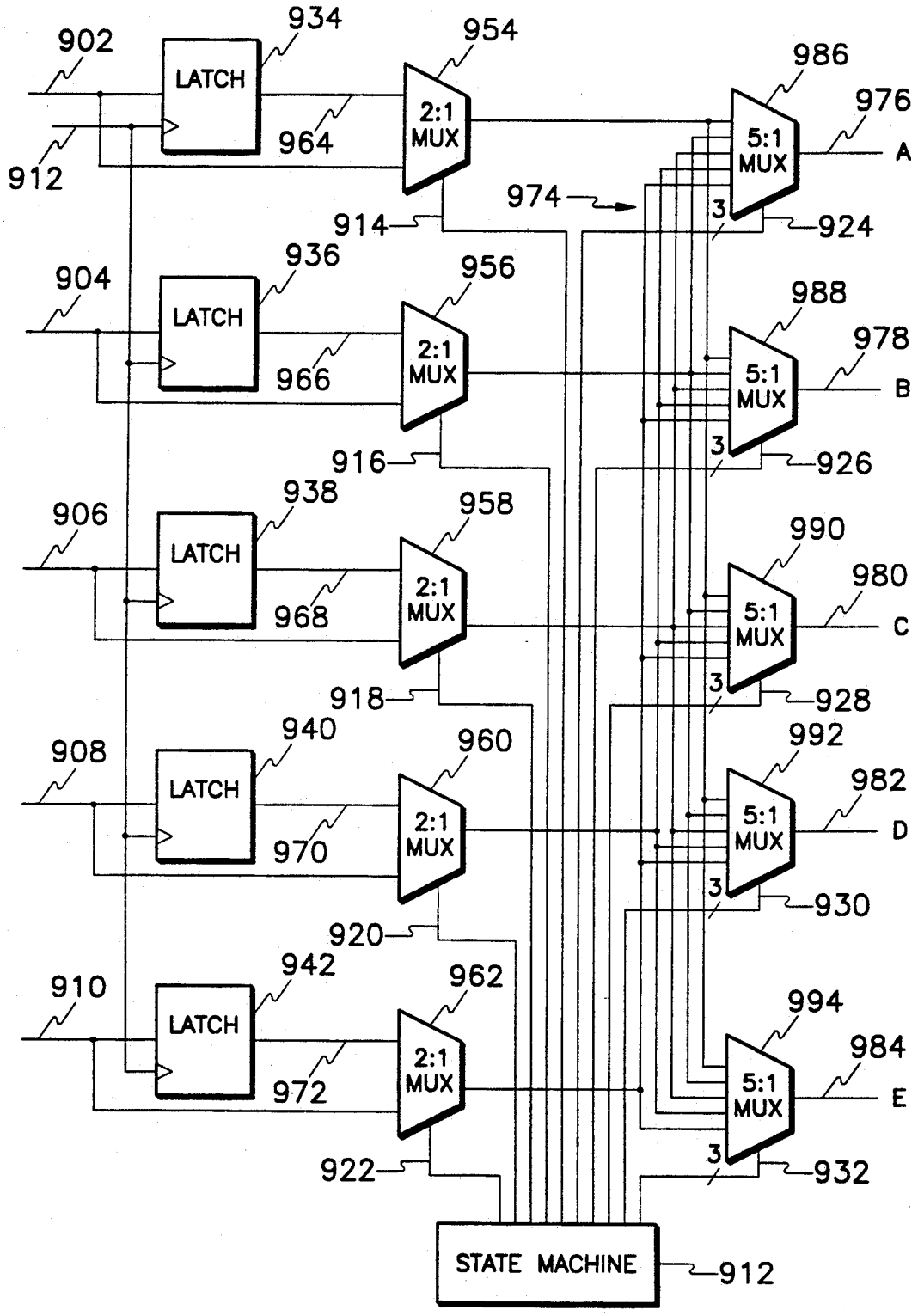
FIG. 9 is an alternative embodiment of the pixel multiplexer circuitry for one pixel plane.

(9) An Alternate Embodiment of the Pixel Multiplexer Circuitry for One Pixel Plane FIG. 9 shows an alternate embodiment of pixel multiplexer circuitry for one pixel plane. The circuit of FIG. 9 uses a combination of 2 to 1 multiplexers (MUXs), 5 to 1 multiplexers and single bit latches to perform merge and manipulate operations. This embodiment is simpler than the embodiment of FIG. 2 and but less functional. The embodiment of FIG. 9 is also easily embodied in discrete components.

The circuit of FIG. 9 is intended to have the ability to merge and manipulate the data from one framestore. It is however possible to modify the circuit for use with two framestores. This will be explained in detail later.

In operation, on the first cycle of gated group clock 302, a one bit deep plane of a first input pixel group is clocked from the framestore, (the memory used to refresh the displayed image) to latch inputs 902, 904, 906, 908 and 910. Gated group clock 302 is tied to common clock input 912.

Concurrent with the beginning of the first cycle, one bit of control data from state machine 912 is asserted on each of 2:1 MUX select inputs 914, 916, 918, 920 and 922. At the same time, three bits of control data from state machine 912 is asserted on 5:1 MUX select inputs 924, 926, 928, 930 and 932.

On the second cycle of the gated group clock 302, the 5 bits of pixel group data are loaded, one bit each, into latches 934, 936, 938, 940 and 942. On the same, (first), gated group clock cycle, a second 5 bit wide plane of pixel group data is clocked on to the latch inputs. The dat in latches 934, 936, 938, 940 and 942 is referred to as the "previous" pixel group data, and the data at latch inputs 902, 904, 906, 908 and 910 is referred to as the "current" pixel group data.

By the end of the second clock cycle the "previous" pixel group data in latches 934, 936, 938, 940 and 942 has been asserted and is stable on inputs 944, 946, 948, 950 and 952 of 2:1 MUXs 954, 956, 958, 960 and 962. Similarly, by the end of the second clock cycle, the "current" pixel group data is asserted and is stable on inputs 964, 966, 968, 970 and 972 of the 2:1 MUXs. Further, by the end of the second clock cycle, selected data from the "current" or "previous" pixel group will be stable on 5 bit wide bus 974 (depending on the control data from state machine 912) and on the inputs to each of five to 1 multiplexers 986, 988, 990, 992 and 994. Similarly, a processed output group of pixel data will be formed at outputs 976, 978, 980, 982 and 984 of 5:1 MUXs 986, 988, 990, 992 and 994 (the exact selection of pixel data also depending on the control data from state machine 912). It should be understood that outputs 976, 978, 980, 982 and 984 correspond to pixel positions A, B, C, D, and E respectively.

The output pixel group data is preferably fed to the inputs to a five bit latch (not shown) and clocked into the latch on the third clock cycle before being asserted on the systems ramdac.

It should be understood that this circuit operates in a similar manner to the circuit of FIG. 2. One bit of control data from state machine 912 is asserted at each of the select inputs of the 2:1 MUXs, (five bits of control information in total), in order to select between the "current" and "previous" patch. Three bits of control data are asserted at each of the select inputs of the 5:1 multiplexers, (15 bits of control information), to further process the selected pixel data. In this embodiment, a total of 20 bits of control information are used form the output pixel group.

State machine 912 is preferably a static RAM and operates using the same principles as are described in section 2. It should be understood, however, that the embodiment of FIG. 9 will allow for less permutations of pixel data than the embodiment of FIG. 2. Advantageously, the latches and 2:1 muxes are contained in one type of chip, an 74AS652 (availablle from Texas Instruments, Inc.). Each '652 is contains an 8 bit register which may be used to latch all 8 planes. Five '652s are used, in total, to latch the input pixels. The 5:1 muxes are implemented in 22V10A programable logic arrays (pals). Eleven pals are needed to mux all 40 lines. In one embodiment, the pals implement 6:1 muxes: the sixth input selecting 0 so as to force the output to a preselected border color (see section IV(3) for a further explanation of this feature).

In order to allow for the processing of data from more than one framestore, two banks of '652s are used, one for each frame. One bank only is output enabled at a time by bank select signals. This allows the invention to use only 23 state machine output signals, fitting into a 24 bit wide ram block (3, 2K×8 bit wide RAM chips).

Just as for the circuit of FIG. 2, one of the multiplexer circuits of FIG. 9 is used to process each plane of pixel data within the pixel group. Each FIG. 9 circuit shares common control data from state machine 912, and a common gated group clock 302. The outputs and inputs of the FIG. 9 circuit are used in parallel to form a complete multiplane pixel group.

(10) Conclusion

Many modifications and improvements to the preferred embodiments will now occur to those skilled in the art. For example, RAM 104 may be replaced with any type of state machine. Further, the RAM may be enlarged as technology will allow (for example so as to have one control table for every horizontal scan line). The state machine could also be eliminated and the control lines could be driven with data from the framestores themselves (for example by using one plane of the image to control the shape of the window). The invention is also easily modified for use within environments other than graphics/image processing computers. For example, the circuitry of a tomography device or echo doppler imager may be modified so as to utilize the benefits of the invention. The invention is also easily modified to process data from more than two framestores. Further, the invention may be used to process data from data input devices other than frame memorys (e.g. directly from a camera interface). The graphics processor and/or video timing generator may also be eliminated and replaced with other circuitry. All that is required is that the environment provide the clock signals, control signals and address bits necessary for the given application.

Many other embodiments of the invention may also be foreseen as technology improves. For example, the entire pixel multiplexer circuit could be placed within the ramdac. In this embodiment, it might be desirable to have only one set of input registers and to multiplex the data from two different framestores outside of the ramdac. Also, the circuitry might be expanded to accommodate the wider pixel groups necessary to cope with increasing video rates. It is also possible that the circuitry to process more pixel planes independently will be deemed necessary or desirable for future or present needs.

Therefore, while the preferred embodiments have been described there should not be taken as a limitation of the present invention but only as exemplary thereof.

APPENDIX - A

Control Table Example for a 2:1 Zoom of two Pixel Groups

| ### | Control Table |
|---|---|
| 001 | 11110001100111010110111 1100 |
| 002 | 01110001100111010110111 1100 |
| 003 | 11010000100001001010010 1010 |
| 004 | 01010100101101011011000 1100 |
| 005 | 11010000100001001010010 1010 |
| 006 | 11010100101101011011000 1100 |
| 007 | 11110001100111010110111 1100 |
| ... | " |
| 256 | 11110001100111010110111 1100 |

What is claimed is:

1. An image processing apparatus, comprising:

clock means for supplying a clock signal;

first register means responsive to the clock means to load and hold a pixel group of pixel data;

second register means responsive to the clock means to load and hold the pixel group of pixel data held in the first register means;

output register means to hold a group of pixel data;

distribution means operable to supply to each pixel location in the output register means, the pixel data in any respective selected one of the pixel locations in the first and second register means.

2. The apparatus of claim 1, further comprising a state machine for controlling the selection of the pixel locations.

3. An image processing apparatus, comprising:

memory means for storing pixel data relating to an image;

reading means for reading pixel data from the memory means in a predetermined order and providing the read pixel data distributed in pixel groups of predetermined size;

processing means for receiving the pixel groups and modifying the distribution of the pixel data among the pixel groups; and control means for supplying control data individually determined for each modified pixel group, the processing means being responsive to the control data once for each modified pixel group which is formed and being operable to modify the distribution of pixel data in accordance with the control data.

4. The apparatus of claim 3, wherein the control means includes a state machine.

5. The apparatus of claim 4, in which the state machine comprises a random access memory.

6. An image processing apparatus comprising:

first and second memory means for storing pixel data relating to first and second images respectively;

first and second reading means for reading pixel data from the first and second memory means respectively in a predetermined order and providing the read pixel data distributed in pixel groups of predetermined size;

processing means for receiving the pixel groups and modifying the distribution of the pixel data among the pixel groups, said processing means being selectably operable to form at least one of the processed pixel groups from a mixture of pixel data from the first reading means and from the second reading means.

7. The apparatus of claim 6, wherein each of said first and second memory means comprises a video RAM and the reading means includes a shift register for reading a line of pixel data from the video RAM.

8. The apparatus of claim 6 further comprising output means for producing an image from the processed pixel groups.

9. The apparatus of claim 8, wherein the output means includes a bit mapped display device.

10. The apparatus of claim 9, wherein the processed pixel groups have the same format as the received pixel groups.

11. The apparatus of claim 6, wherein the processing means is also selectably operable to shift the locations of pixel data in the pixel groups.

12. The apparatus of claim 6, wherein the processing means is also selectably operable to repeat at least some of the pixel data in the pixel groups and to shift the pixel data in and amongst the pixel groups to accommodate the repeated pixel data.

13. The apparatus of claim 6, wherein the processing means comprises means for receiving pixel data in the form of a pixel group, means for outputting pixel data in the form of a pixel group, and distributing means for causing each pixel data in the output pixel group to be selected from any respective one of the pixel data in the received pixel group.

14. The apparatus of claim 13, wherein the distributing means is operable to select at least two of the pixel data for adjacent pixels in an output pixel group from the same pixel data in the received pixel group.

15. The apparatus of claim 13, wherein the pixel data receiving means is operable to receive two pixel groups, the distributing means being operable to select each pixel data in an output pixel group from any respective selected one of the pixel data in the two received pixel groups.

16. The apparatus of claim 15, wherein the received pixel groups relate to two successive pixel groups for the same image, and the distributing means includes means to temporarily store the earlier of the two received pixel groups.

17. The apparatus of claim 15, wherein the received pixel groups relate to different images.

18. The apparatus of claim 6, further comprising control means for supplying control data, the processing means being responsive to the control data once for each modified pixel group which is formed and being operable to modify the distribution of pixel data in accordance with the control data.

19. The apparatus of claim 18, wherein the control means includes a state machine operable to determine said control signal individually for each modified pixel group.

20. The apparatus of claim 19, wherein the state machine comprises a random access memory.

21. A method of providing an image window on a display monitor comprising the steps of:

(a) accessing a first pixel group of pixel data relating to a first image;

(b) accessing a second pixel group of pixel data relating to a second image;

(c) receiving control data;

(d) selecting, responsive to the control data, the pixel data from the first pixel group to be displayed in each pixel group position of each horizontal scan line of the display monitor; and (e) selecting, responsive to the control data, the pixel data from the second pixel group to be displayed in each pixel group position of each horizontal scan line of the display monitor.

22. An image processing apparatus comprising:

first memory means for storing pixel data relating to an image;

first reading means for reading pixel data from the memory means in a predetermined order and providing the read pixel data distributed in pixel groups of predetermined size; and processing means for receiving the pixel groups and modifying the distribution of the pixel data among the pixel groups, said processing means being selectably operable to repeat at least some of the pixel data in the pixel groups and to shift the pixel data in and amongst the pixel groups to accommodate the repeated pixel data.

23. The apparatus of claim 22, wherein the memory means comprises a video RAM and the reading means includes a shift register for reading a line of pixel data from the video RAM.

24. The apparatus of any of claims 22 or 23, further comprising output means for producing an image from the processed pixel groups.

25. The apparatus of claim 24, wherein the output means includes a bit mapped display device.

26. The apparatus of claim 22, wherein the processing means is also selectably operable to shift the locations of pixel data in the pixel groups without repetition.

27. The apparatus of claim 22, further comprising second memory means for storing pixel data relating to another image; and second reading means for reading pixel data from the second memory means; the processing means being operable to form at least one of the processed pixel groups from a mixture of pixel data from the first reading means and from the second reading means.

28. The apparatus of claim 22, wherein the processing means comprises means for receiving pixel data in the form of a pixel group, means for outputting pixel data in the form of an output pixel group, and distributing means for causing each pixel data in the output pixel group to be selected from any respective one of the pixel data in the received pixel group.

29. The apparatus of claim 28, wherein the distributing means is operable to select at least two of the pixel data for adjacent pixels in an output pixel group from the same pixel data in the received pixel group.

30. The apparatus of claim 28, wherein the pixel data receiving means is operable to receive two pixel groups, the distributing means being operable to select each pixel data in an output pixel group from any respective selected one of the pixel data in the two received pixel groups.

31. The apparatus of claim 30, wherein the received pixel groups relate to two successive pixel groups for the same image, the distributing means including means to store temporarily the earlier of the two received pixel groups.

32. The apparatus of claim 31, wherein the received pixel groups relate to different images.

33. The apparatus of claim 32, further comprising control means for supplying control data, the processing means being responsive to the control data once for each modified pixel group which is formed and being operable to modify the distribution of pixel data in accordance with the control data.

34. The apparatus of claim 33, wherein the control means includes a state machine operable to determine said control signal individually for each modified pixel group.

35. The apparatus of claim 34, wherein the state machine comprises a random access memory.

36. A method of magnifying an image on a display monitor by predetermined horizontal and vertical magnification factors comprising the steps of:

(a) accessing a first pixel group of pixel data;

(b) accessing a second pixel group of pixel data;

(c) receiving control data;

(d) selecting from among the pixel data in the first and second pixel groups, responsive to said control data;

(e) forming an output pixel group of pixel data by causing at least one of the selected pixel data to appear in a predetermined plural number of consecutive positions in the output pixel group;

(f) repeating steps a, b and c, d and e for a number of horizontal scan lines of the display monitor.

* * * * *